US008297471B2

(12) United States Patent
Dooley et al.

(10) Patent No.: US 8,297,471 B2
(45) Date of Patent: Oct. 30, 2012

(54) INTERACTIVE MANUAL CUP DISPENSER

(76) Inventors: Christopher P. Dooley, New Caanan, CT (US); Loren Tayior, Chetham, NJ (US); Paul S Nielsen, Saratoga Springs, NY (US); Gwen Nielsen, legal representative, Saratoga Springs, NY (US)

( * ) Notice: Subject to any disclaimer, the term of this patent is extended or adjusted under 35 U.S.C. 154(b) by 99 days.

(21) Appl. No.: 13/119,241

(22) PCT Filed: Oct. 23, 2009

(86) PCT No.: PCT/US2009/061861

§ 371 (c)(1),
(2), (4) Date: Mar. 16, 2011

(87) PCT Pub. No.: WO2010/062529

PCT Pub. Date: Jun. 3, 2010

(65) Prior Publication Data

US 2011/0248041 A1 Oct. 13, 2011

Related U.S. Application Data

(60) Provisional application No. 61/108,579, filed on Oct. 27, 2008.

(51) Int. Cl.
*B65D 83/00* (2006.01)
*B65G 59/00* (2006.01)
*A47F 1/06* (2006.01)

(52) U.S. Cl. ..... 221/2; 221/3; 221/1; 221/199

(58) Field of Classification Search ..... 221/1–3, 221/24, 199

See application file for complete search history.

(56) References Cited

U.S. PATENT DOCUMENTS

| | | | | |
|---|---|---|---|---|
| 5,000,345 | A * | 3/1991 | Brogna et al. | 221/5 |
| 5,771,778 | A * | 6/1998 | MacLean, IV | 99/323.6 |
| 5,786,749 | A | 7/1998 | Johnson et al. | |
| 6,659,305 | B2 * | 12/2003 | Thompson | 221/223 |
| 6,881,380 | B1 | 4/2005 | Mootz et al. | |
| 7,308,916 | B2 * | 12/2007 | Akuzawa et al. | 141/174 |
| 7,410,269 | B2 | 8/2008 | Harrity et al. | |
| 7,757,890 | B2 * | 7/2010 | Alford et al. | 221/2 |
| 2008/0008865 | A1 | 1/2008 | Lulu et al. | |
| 2009/0140000 | A1 * | 6/2009 | Davis, Jr. | 221/2 |
| 2010/0012676 | A1 * | 1/2010 | Freedman | 221/24 |

FOREIGN PATENT DOCUMENTS

| | | | |
|---|---|---|---|
| JP | 05-08534 | U | 11/1993 |
| JP | 07-275491 | A | 10/1995 |
| KR | 20-0360786 | Y1 | 9/2004 |

* cited by examiner

*Primary Examiner* — Michael K Collins
(74) *Attorney, Agent, or Firm* — Michael Crilly, Esq.

(57) ABSTRACT

A use-activated cup dispenser capable of sensing the manual removal of individual cups therefrom is provided. Manual removal is understood to include physical contact between a hand and a cup and extraction of the cup from the cup dispenser by the user. The invention includes a decorative cover including a housing disposed between first and second covers, at least one switch mechanism, a control circuit, and at least one active element including light elements, motor elements, scent dispensers, and/or audio elements. The decorative cover further includes an opening along one end. One or more switch mechanisms are provided along the first cover adjacent to the opening. The functionality of switch mechanisms includes direct contact, indirect contact, and non-contact between the cup and an optical or mechanical switch. The control circuit could be disposed on a circuit board and controls the functionality of the active elements. Active elements are attached to the decorative cover and are actuated when a cup interacts with at least one switch mechanism. Active elements enhance the entertainment and interactive properties of the cup dispenser.

23 Claims, 18 Drawing Sheets

INTERACTIVE MANUAL CUP DISPENSER

CROSS REFERENCE TO RELATED APPLICATIONS

This application is based upon and claims priority from U.S. Provisional Application No. 61/108,579 filed Oct. 27, 2008 entitled Cup Dispenser with Activatable Elements and PCT Application No. PCT/US2009/061861 filed Oct. 23, 2009 entitled Interactive Manual Cup Dispenser, which are hereby incorporated in their entirety by reference thereto.

FEDERALLY SPONSORED RESEARCH AND DEVELOPMENT

None.

BACKGROUND OF THE INVENTION

1. Field of the Invention

The invention generally relates to an interactive cup dispenser including elements which produce light, sound, motion, and/or scent when activated by the manual removal of a cup. Specifically, the invention includes a decorative cover having at least one switch mechanism communicating with a control circuit, a power supply, and at least one light, sound, motion, and/or scent element. A variety of switching mechanisms including direct, indirect, or non-contact means are provided for activating effects which stimulate one or more sensory organs of the user to enhance the entertainment value of the dispenser.

2. Background

The related arts include two noteworthy cup holding devices.

Harrity et al., U.S. Pat. No. 7,410,269, describes a decorative light system including a base and a portable light device which generates a light show. The base could also provide a storage location for other non-rechargeable items, such as a hair brush or a drinking cup. The device does not include the structure and functionality of the present invention.

Johnson et al., U.S. Pat. No. 5,786,749, describes a toothbrush holder with integrated sound device activated by the removal of a toothbrush. A cup dispenser is also provided but does not interact with the sound device.

Accordingly, the related arts do not include a decorative dispenser for use within a kitchen or bathroom capable of holding a plurality of disposable cups therein whereby the manual removal of a cup activates of visual, audio, and/or smell effects which enhance the interaction.

Therefore, what is required is a cup dispenser, for use within a kitchen, bathroom, or the like, having light, sound, motion, and/or scent producing elements thereon which are activated in a reliable fashion when a cup is manually removed from the dispenser.

SUMMARY OF THE INVENTION

An object of the invention is to provide a cup dispenser, for use within a kitchen, bathroom, or the like, having light, sound, motion, and/or scent producing elements thereon which are activated in a reliable fashion when a cup is manually removed the dispenser.

In accordance with embodiments of the invention, the manual cup dispenser includes a decorative cover, at least one switch mechanism, at least one active element, and a control circuit. The decorative cover includes an opening at one end for the manual removal of at least one of a plurality of cups stacked therein. Switch mechanisms are disposed adjacent to the opening. Active elements are disposed along the decorative cover and produce light, sound, scent, and/or motion for a finite period after a cup is manually removed from the dispenser. Active elements have a form and/or a function that enhance the entertainment value of the dispenser. The control circuit communicates with the switch mechanisms, a power supply, and/or active elements to control the functionality of the active elements. Manual removal is understood to include physical contact between a user's hand and a cup and extraction of the cup from the cup dispenser via the user's hand, rather than a motor or other mechanized element. In other embodiments of the invention, the switch mechanism directly contacts at least one cup.

In other embodiments of the invention, the switch mechanism is vibration, tilt, lever, or momentary activated.

In other embodiments of the invention, the switch mechanism does not contact the cups.

In other embodiments of the invention, the switch mechanism is activated via the interrupt of visible or invisible light.

In other embodiments of the invention, the switch mechanism is activated via the reflection of visible or invisible light.

In other embodiments of the invention, the switch mechanism communicates contact with at least one cup to a switch.

In other embodiments of the invention, the switch mechanism includes an expansion ring which activates the active elements when a cup is removed from the dispenser and the switch is mechanically or optically actuated.

In other embodiments of the invention, the switch mechanism includes a rocker element which activates the active elements when a cup is removed from the dispenser and the switch is mechanically or optically actuated.

In other embodiments of the invention, the switch mechanism includes a roller element which activates the active elements when a cup is removed from the dispenser and the switch is mechanically or optically actuated.

In other embodiments of the invention, the roller element has a plurality of fingers extending therefrom which contact at least one cup so as to engage the active elements.

In other embodiments of the invention, the active elements illuminate the decorative cover.

In other embodiments of the invention, the finite period is time or event based.

In other embodiments of the invention, the cup dispenser includes a spring mechanism disposed within the decorative cover so as to assist the manual removal of a cup.

In other embodiments of the invention, the cup dispenser includes a secondary switch disposed along the decorative cover and capable of activating and/or deactivating the active elements separate from or independent of the removal of a cup.

In other embodiments of the invention, the cup dispenser includes at least one contact element disposed along the exterior of the dispenser for securing the dispenser along a support surface.

In other embodiments of the invention, at least one active element is a light emitting diode, a socket-bulb assembly, or a fiber optical element.

In other embodiments of the invention, at least one active element is a piezo buzzer, a speaker, or an audio device.

In other embodiments of the invention, at least one active element produces scent via atomization, heating, evaporation, airflow, pressure, or vibration.

In other embodiments of the invention, at least one active element is a motor, a solenoid, a bimetal, or a piezoelectric device.

In other embodiments of the invention, active elements are not activated when cups are loaded into the manual cup dispenser and activated when at least one cup is removed from the dispenser.

In other embodiments of the invention, one switch mechanism is activatable when at least one cup is loaded into and removed from the manual cup dispenser.

In other embodiments of the invention, one switch mechanism is activatable when at least one cup is placed into the manual cup dispenser and another switch mechanism is activatable when at least one cup is removed from the cup dispenser.

Several advantages are offered by the invention. The manual functionality of the dispenser and functionality of the switch mechanisms maximize battery life, by limiting power to the sensing and active elements only when a cup is removed by a user. The control circuit limits functionality of the active elements to a predetermined period of finite duration, thus conserving power, extending the functional life of the dispenser, and reducing operational costs.

The above and other objectives, features, and advantages of the preferred embodiments of the invention will become apparent from the following description read in connection with the accompanying drawings, in which like reference numerals designate the same or similar elements.

BRIEF DESCRIPTION OF THE INVENTION

Additional aspects, features, and advantages of the invention will be understood and will become more readily apparent when the invention is considered in the light of the following description made in conjunction with the accompanying drawings.

Figure 4A:
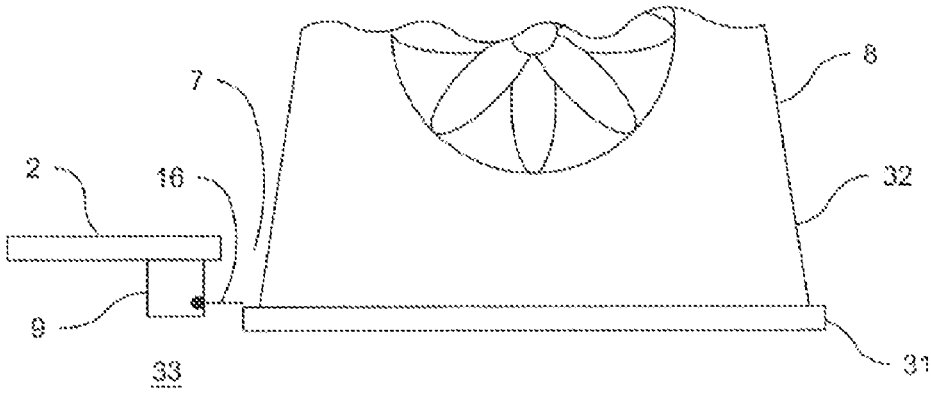

FIG. 4*a* is an enlarged partial section view illustrating a direct contact arrangement between a switch and a cup prior to manual extraction of the cup from a dispenser in accordance with an embodiment of the invention.

Figure 4B:
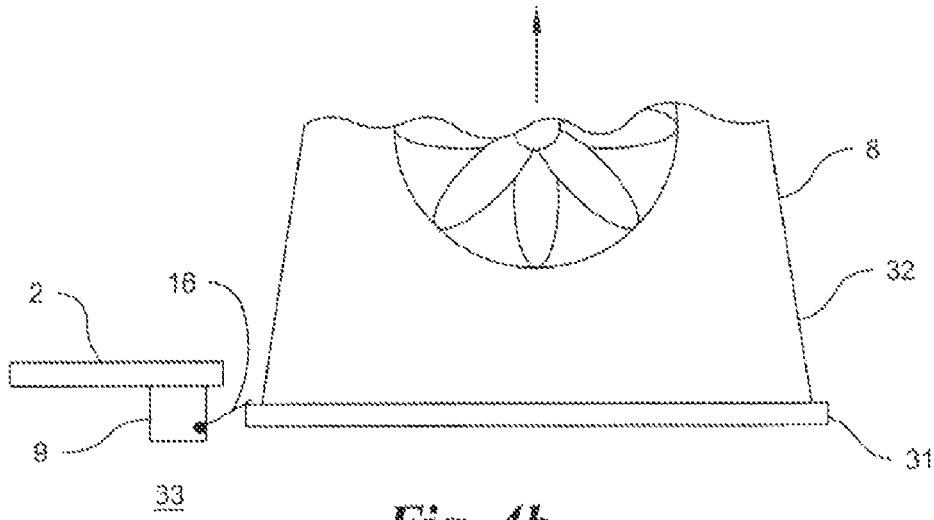

FIG. 4*b* is an enlarged partial section view illustrating the switch and cup during manual extraction of the cup from the dispenser in FIG. 4*a* in accordance with an embodiment of the invention.

Figure 5A:
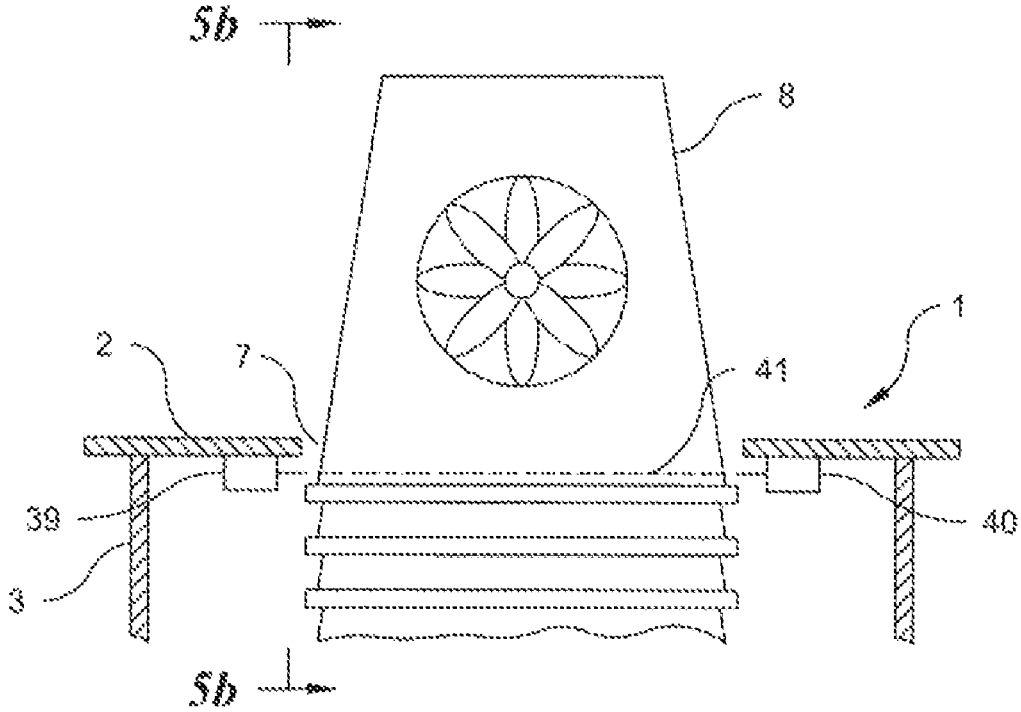

FIG. 5*a* is a partial section view illustrating a non-contact arrangement including light emitter and receiver units disposed about one side of a cup within a cup dispenser so that a light beam is projected past the cup in accordance with an embodiment of the invention.

Figure 5B:
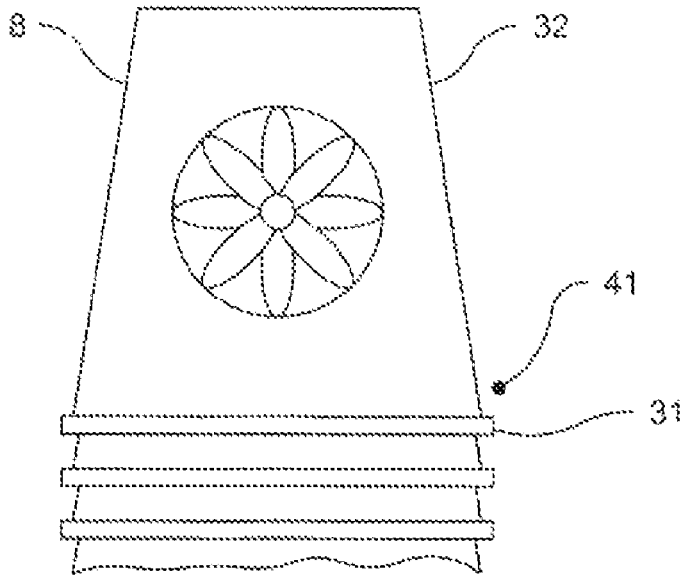

FIG. 5*b* is a side view illustrating arrangement of the light beam adjacent to one side of the cup in FIG. 5*a* in accordance with an embodiment of the invention.

Figure 5C:
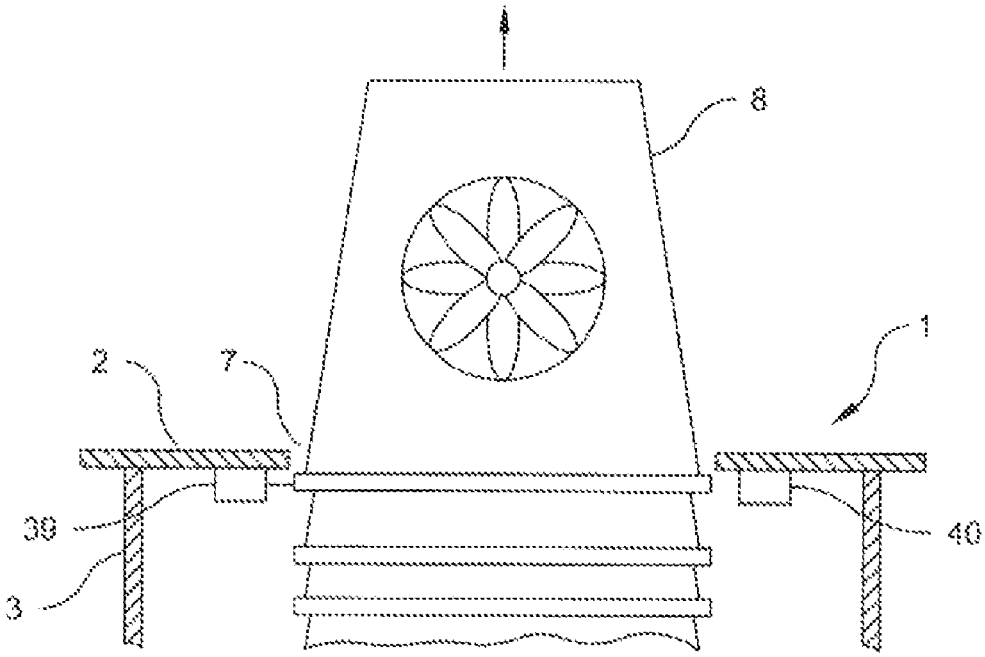

FIG. 5*c* is a partial section view illustrating interruption of the light beam by the rim as the cup is extracted from the dispenser in FIG. 5*a* in accordance with an embodiment of the invention.

Figure 5D:
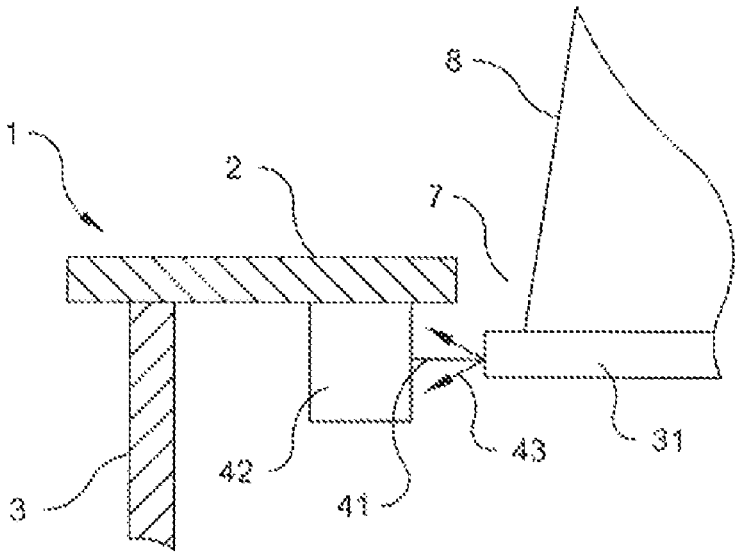

FIG. 5*d* is an enlarged partial section view illustrating a non-contact arrangement with an emitter/receiver unit disposed along one side of a cup as a light beam is reflected back towards the unit by the rim of the cup as the cup is extracted from the dispenser in accordance with an embodiment of the invention.

Figure 6A:
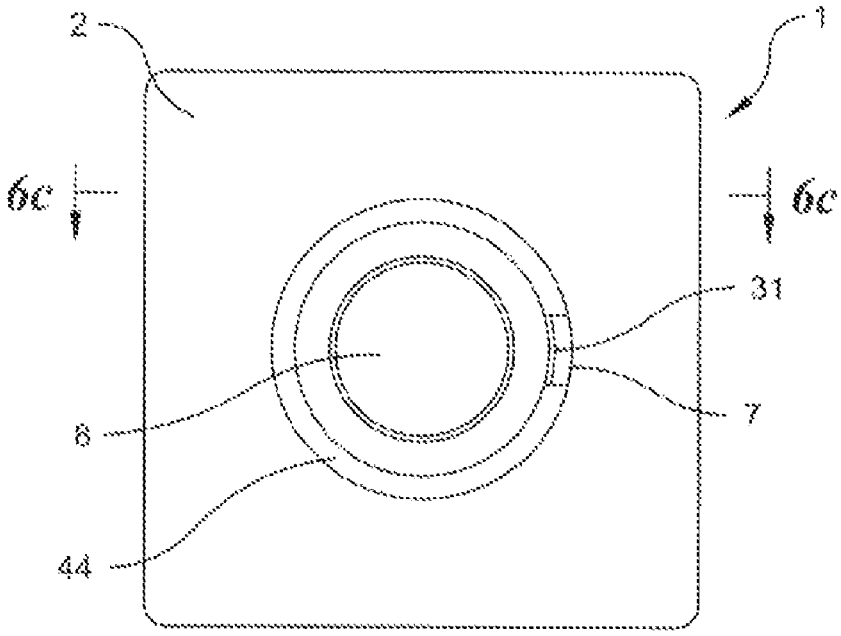

FIG. 6*a* is a top view illustrating an indirect contact arrangement including an expandable ring disposed about a cup which extends through an opening along one end of a cup dispenser in accordance with an embodiment of the invention.

Figure 6B:
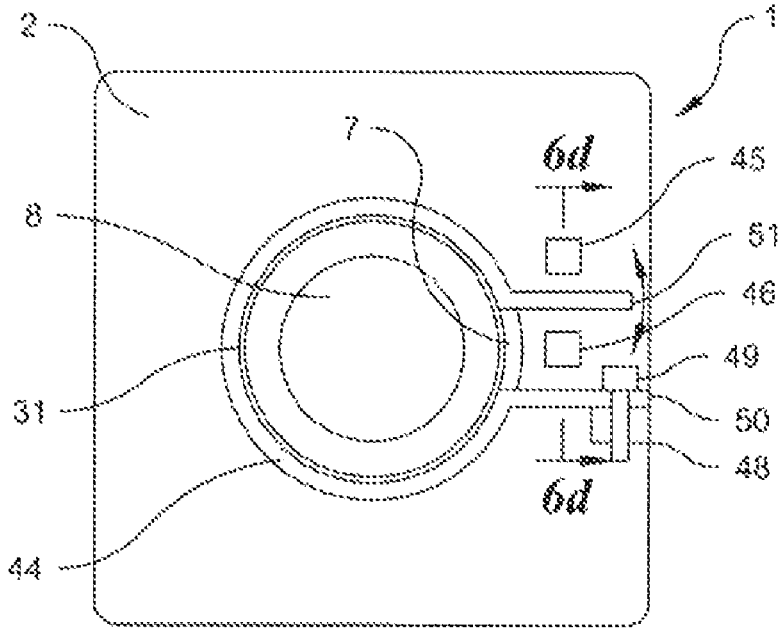

FIG. 6*b* is an interior view illustrating the cup dispenser in FIG. 6*a* with an expandable ring having first and second arms so that the first arm is attached at one end to the dispenser and the second arm is movable between light emitter and receiver units in accordance with an embodiment of the invention.

Figure 6C:
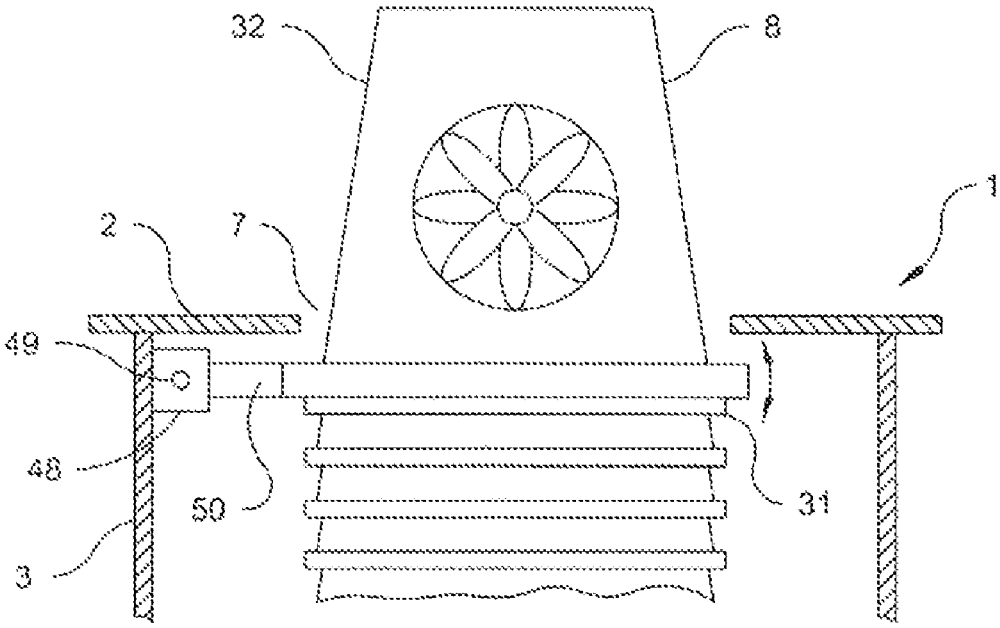

FIG. 6*c* is a partial section view illustrating the cup dispenser in FIG. 6*a* with the body of the cup passing through the expandable ring and opening in accordance with an embodiment of the invention.

Figure 6D:
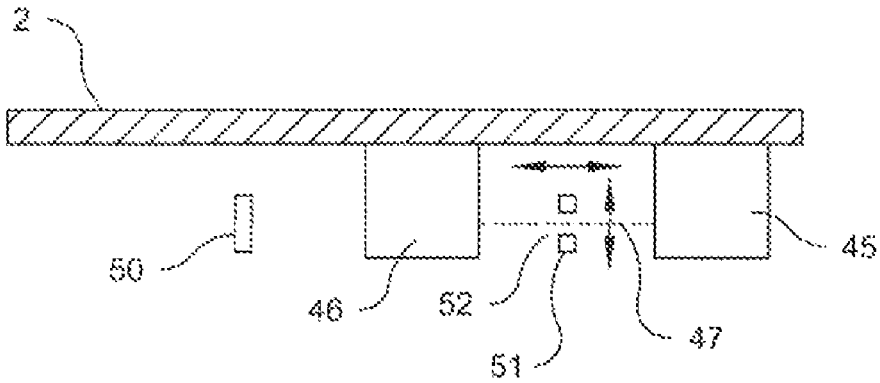

FIG. 6*d* is an enlarged partial section view illustrating the cup dispenser in FIG. 6*a* with the second arm having an opening that allows a light to pass from the emitter to the receiver and otherwise interrupts the light when a cup is removed from the dispenser so as to expand the ring moving the second arm with opening in accordance with an embodiment of the invention.

Figure 7A:
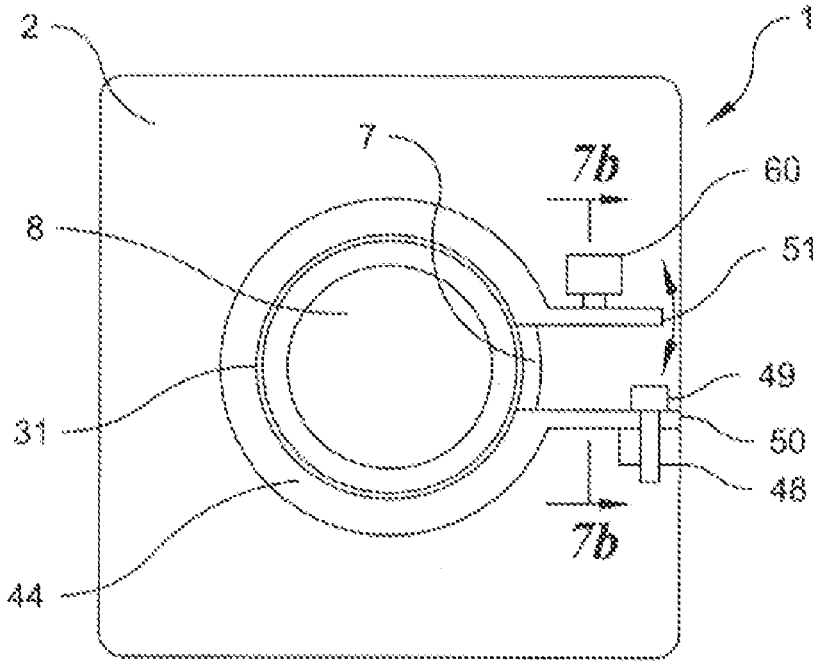

FIG. 7*a* is an interior view along the first cover illustrating the cup dispenser in FIG. 6*a* having an expandable ring with first and second arms so that the first arm is attached at one end to the dispenser and the second arm is movable and adjacent to a mechanical switch in accordance with an embodiment of the invention.

Figure 7B:
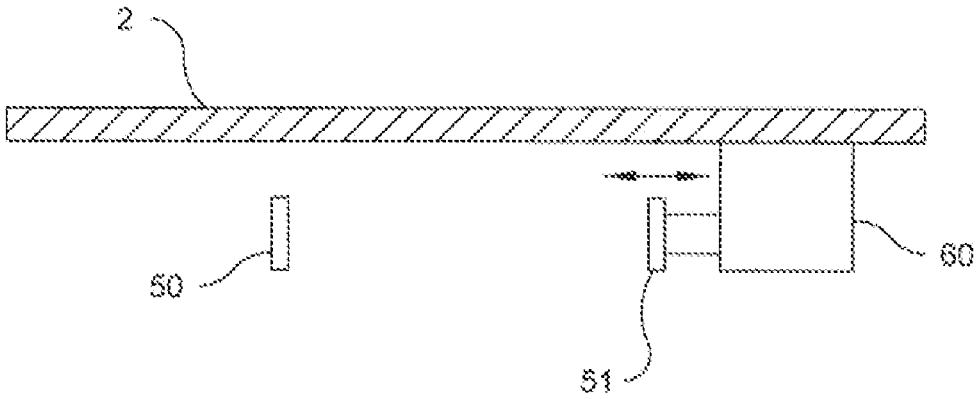

FIG. 7*b* is an enlarged partial section view illustrating the cup dispenser in FIG. 7*a* with the second arm contacting the mechanical switch so that the removal of a cup expands the ring and actuates the mechanical switch in accordance with an embodiment of the invention.

Figure 8A:
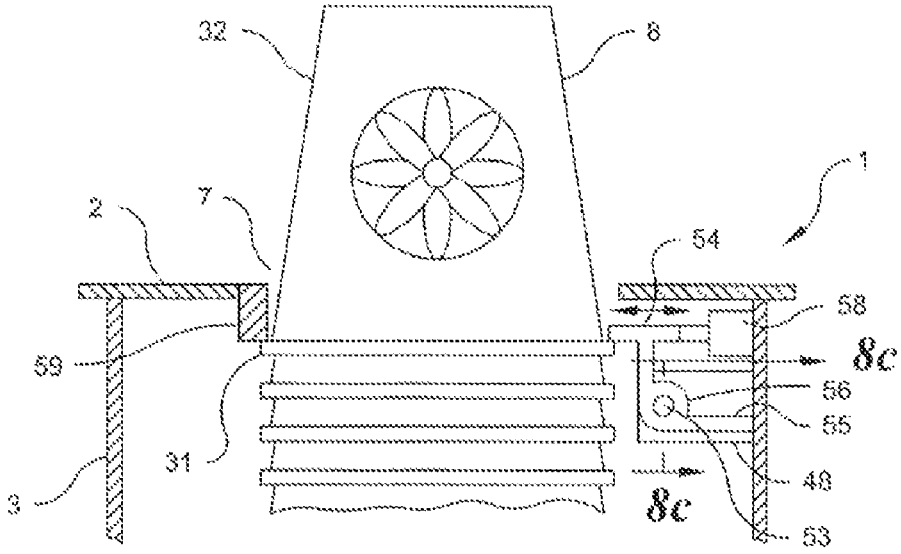

FIG. 8*a* is a partial section view illustrating an indirect contact arrangement including a rocker element which contacts the lower portion of a topmost cup and rotates onto a mechanical switch as the cup is removed from a cup dispenser in accordance with an embodiment of the invention.

Figure 8B:
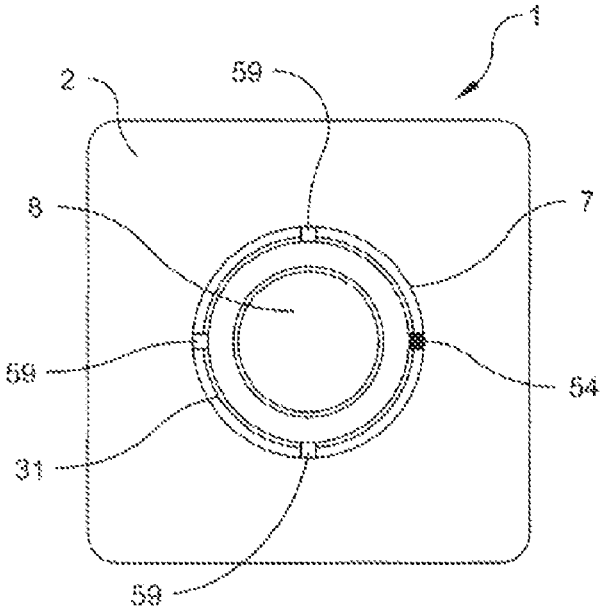

FIG. 8*b* is a top view illustrating the cup dispenser in FIG. 8*a* having stops disposed along the cup dispenser which extend into the opening to prevent the topmost cup from ejecting from the dispenser unless manually removed by the user in accordance with an embodiment of the invention.

Figure 8C:
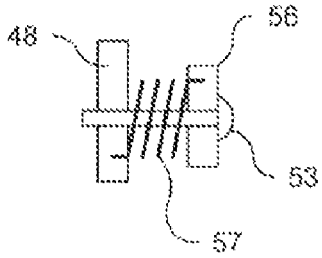

FIG. 8*c* is an enlarged section view illustrating an optional spring between the rocker element and a flange within the cup dispenser in FIG. 8*a* whereby the spring resets the rocker element after a cup is removed from the dispenser in accordance with an embodiment of the invention.

Figure 8D:
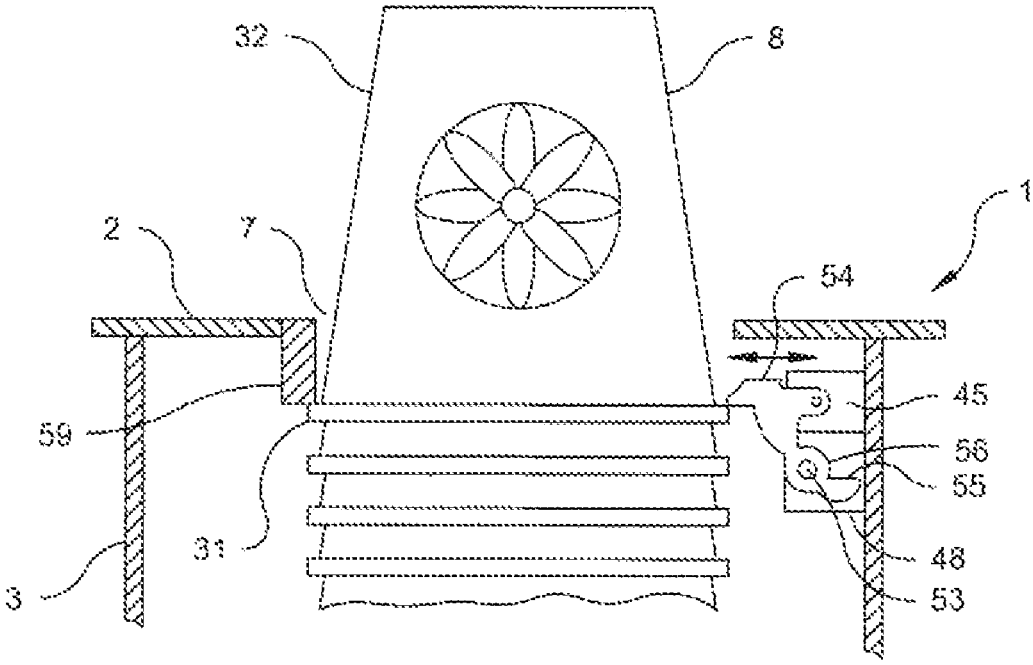

FIG. 8*d* is a partial section view illustrating the cup dispenser in FIG. 8*a* now including a rocker element which contacts a topmost cup and rotates between emitter and receiver units as the cup is removed from a cup dispenser in accordance with an embodiment of the invention.

Figure 9A:
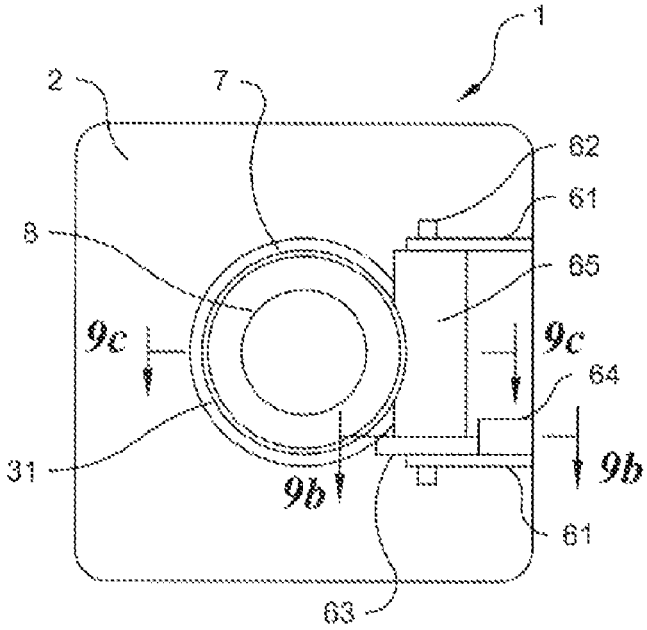

FIG. 9*a* is an interior view along the first cover illustrating an indirect contact arrangement including a roller assembly which contacts a topmost cup within a cup dispenser so as to actuate a mechanical switch within the dispenser when the topmost cup is removed therefrom in accordance with an embodiment of the invention.

Figure 9B:
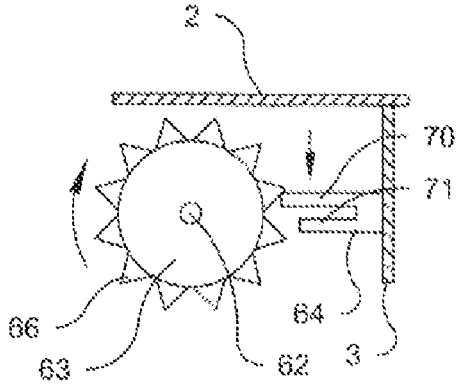

FIG. 9*b* is an enlarged section view illustrating arrangement of a sprocket along one end of the roller assembly and a mechanical switch within the cup dispenser in FIG. 9*a* in accordance with an embodiment of the invention.

Figure 9C:
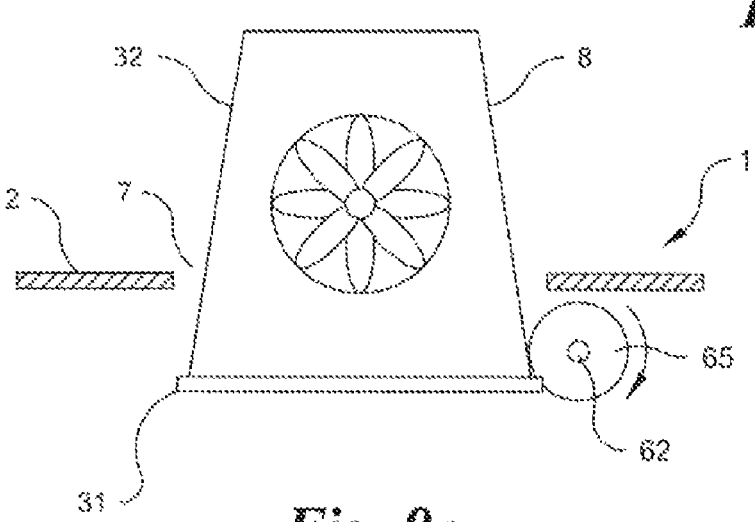

FIG. 9*c* is an enlarged partial section view illustrating contact between the topmost cup and roller body within the cup dispenser in FIG. 9*a* in accordance with an embodiment of the invention.

Figure 10A:
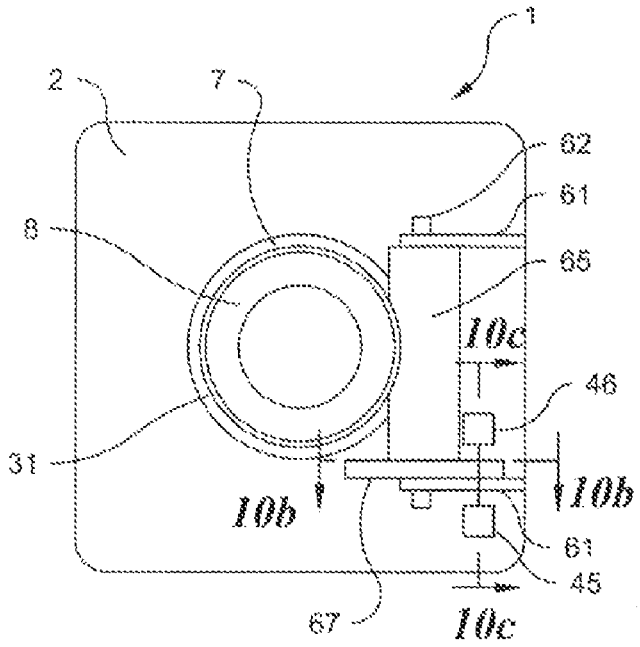

FIG. 10*a* is an interior view along the first cover illustrating an indirect contact arrangement including a roller assembly which contacts a topmost cup within a cup dispenser so as to actuate an optical-based switch within the dispenser when the topmost cup is removed therefrom in accordance with an embodiment of the invention.

Figure 10B:
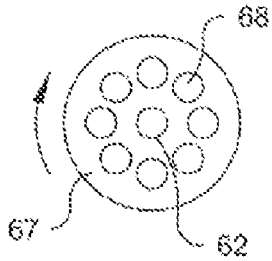

FIG. 10*b* is an enlarged section view illustrating an encoder with a plurality of openings along one end of the roller assembly within the cup dispenser in FIG. 10 a in accordance with an embodiment of the invention.

Figure 10C:
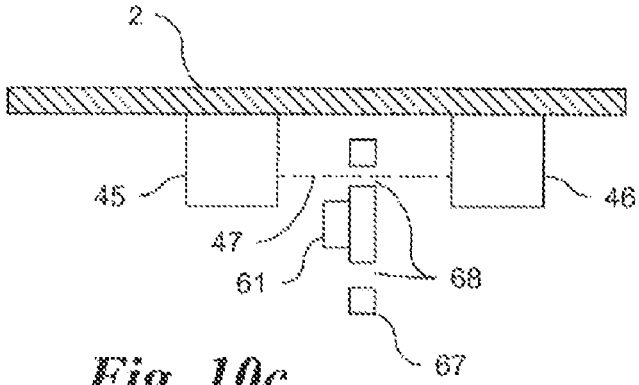

FIG. 10*c* is an enlarged partial section view illustrating arrangement of the encoder between light emitter and receiver units of the optical switch within the cup dispenser in FIGS. 10*a* and 10*b* in accordance with an embodiment of the invention.

Figure 11A:
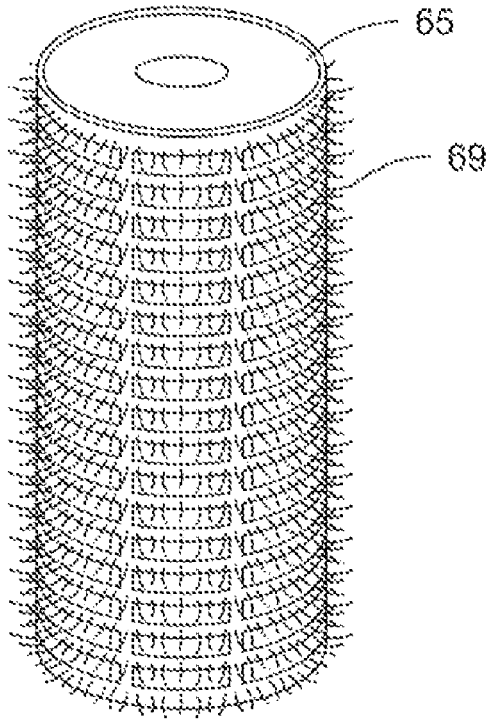

FIG. 11*a* is a perspective view illustrating a plurality of fingers disposed along the exterior surface of a roller body in accordance with an embodiment of the invention.

Figure 11B:
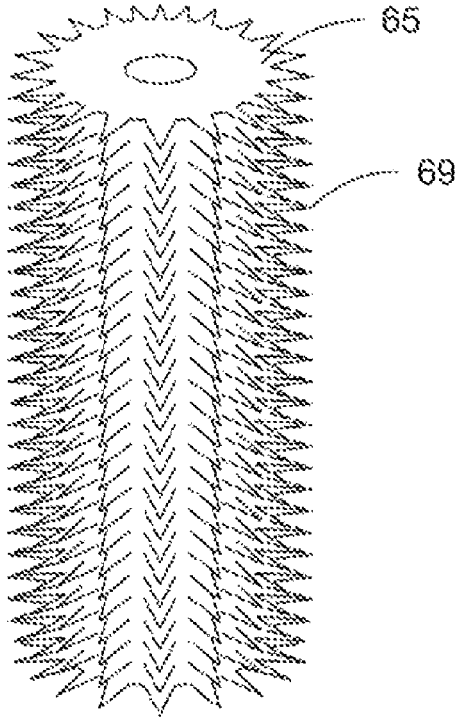

FIG. 11*b* is a perspective view illustrating a plurality of fingers disposed along the exterior surface of a roller body in accordance with an embodiment of the invention.

Figure 12A:
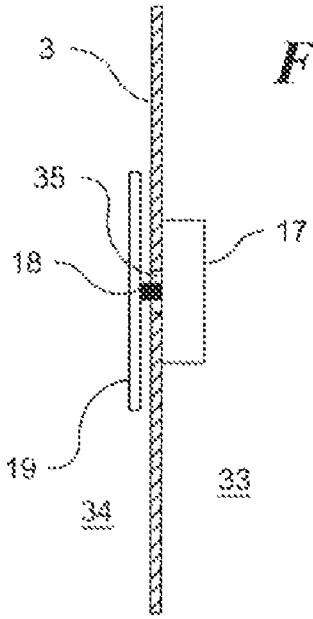

FIG. 12*a* is a partial section view illustrating attachment of a motorized element along a housing of a cup dispenser in accordance with an embodiment of the invention.

Figure 12B:
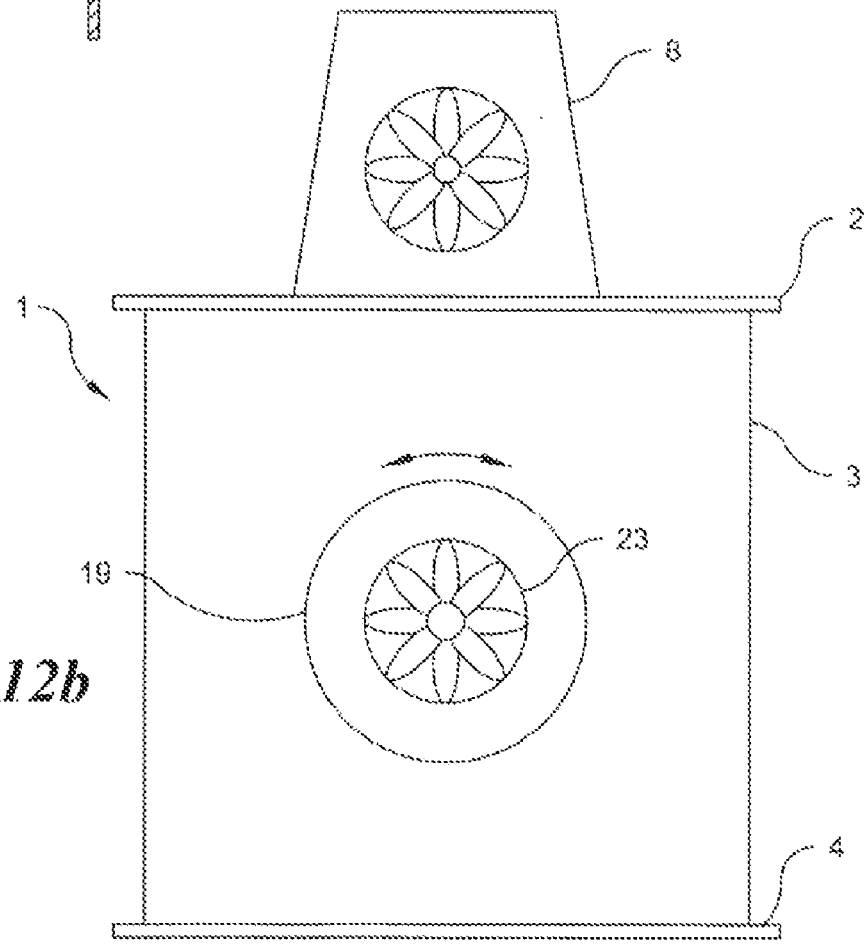

FIG. 12*b* is a side view illustrating a movable ornament along the exterior of the cup dispenser in FIG. 12*a* and attached to the motorized element in accordance with an embodiment of the invention.

Figure 13A:
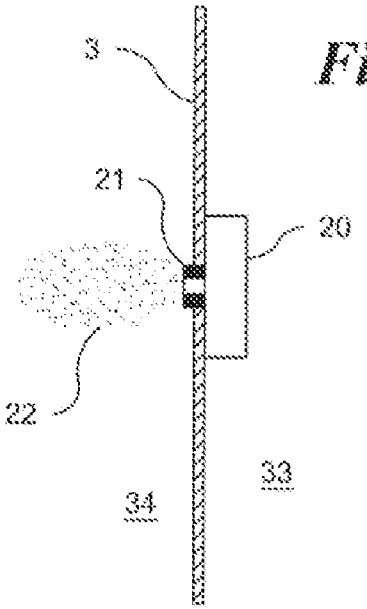

FIG. 13*a* is a partial section view illustrating attachment of a scent dispenser element along a housing of a cup dispenser capable of dispensing a scented cloud in accordance with an embodiment of the invention.

Figure 13B:
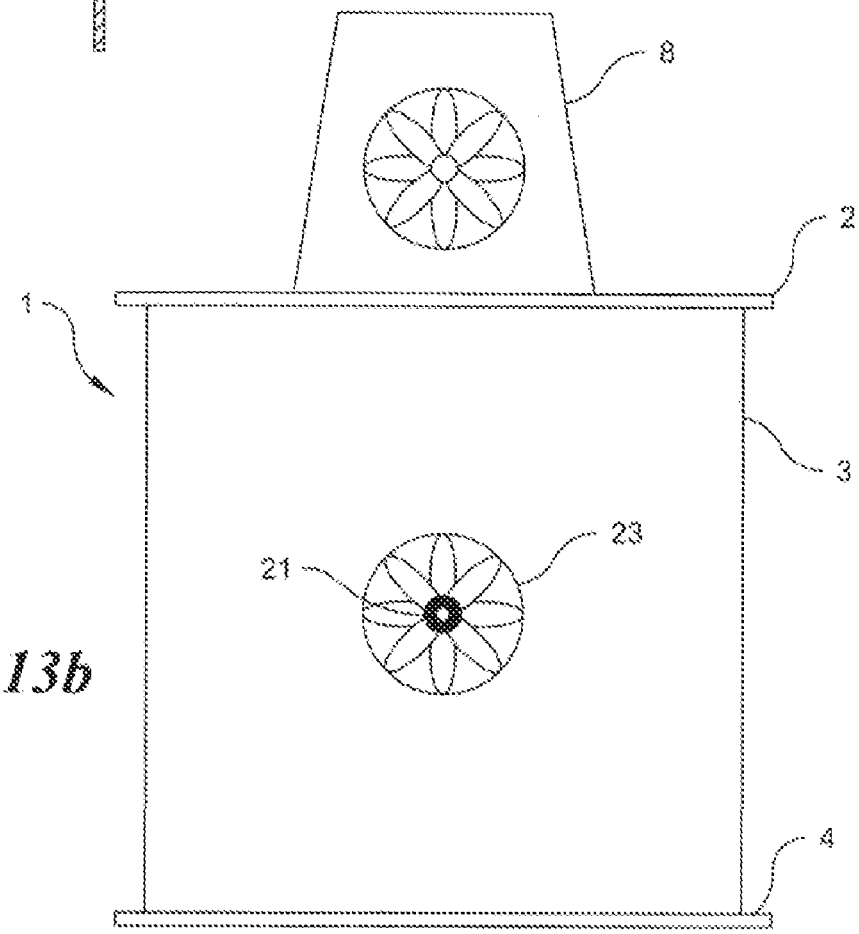

FIG. 13*b* is a side view illustrating a port attached to the dispenser element for the cup dispenser in FIG. 13*a* with optional ornamentation in accordance with an embodiment of the invention.

Figure 14A:
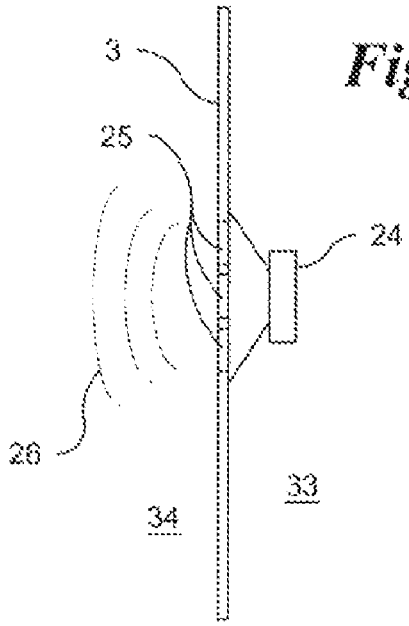

FIG. 14*a* is a partial section view illustrating attachment of an audio element along a housing of a cup dispenser so as to emit sound in accordance with an embodiment of the invention.

Figure 14B:
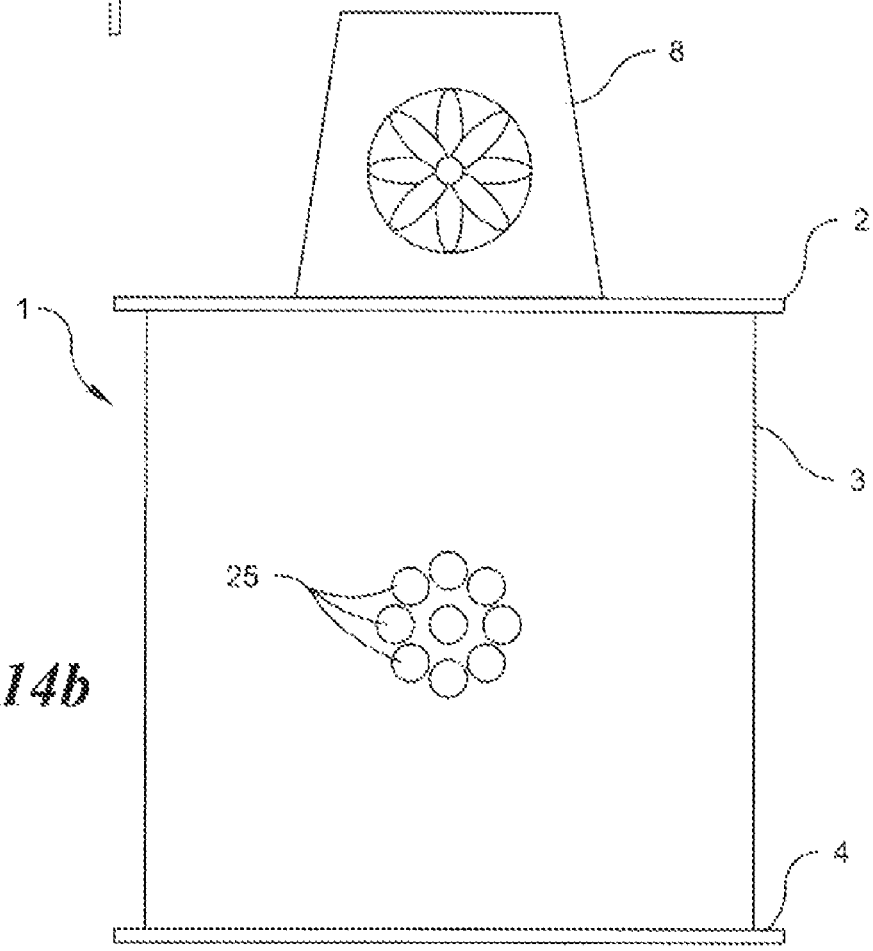

FIG. 14*b* is a side view illustrating openings along the housing for the cup dispenser in FIG. 14*a* through which sound is emitted from the cup dispenser in accordance with an embodiment of the invention.

Figure 15:
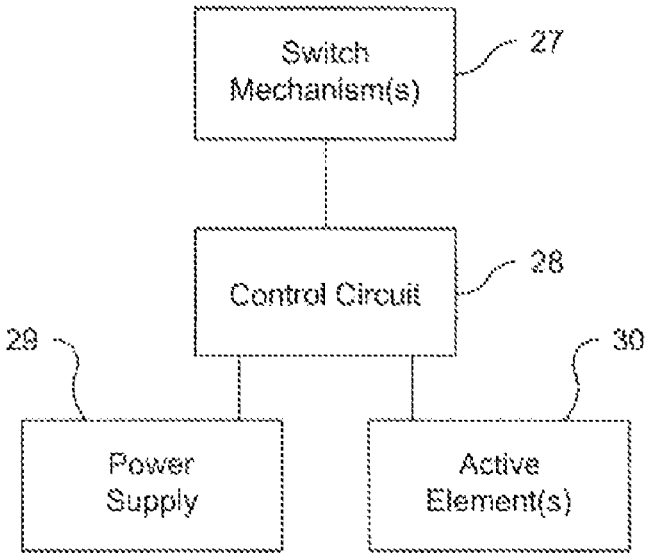

FIG. 15 is a block diagram illustrating electrical connectivity between at least one switch mechanism, at least one active element, a control circuit, and a power supply in accordance with an embodiment of the invention.

Figure 16:
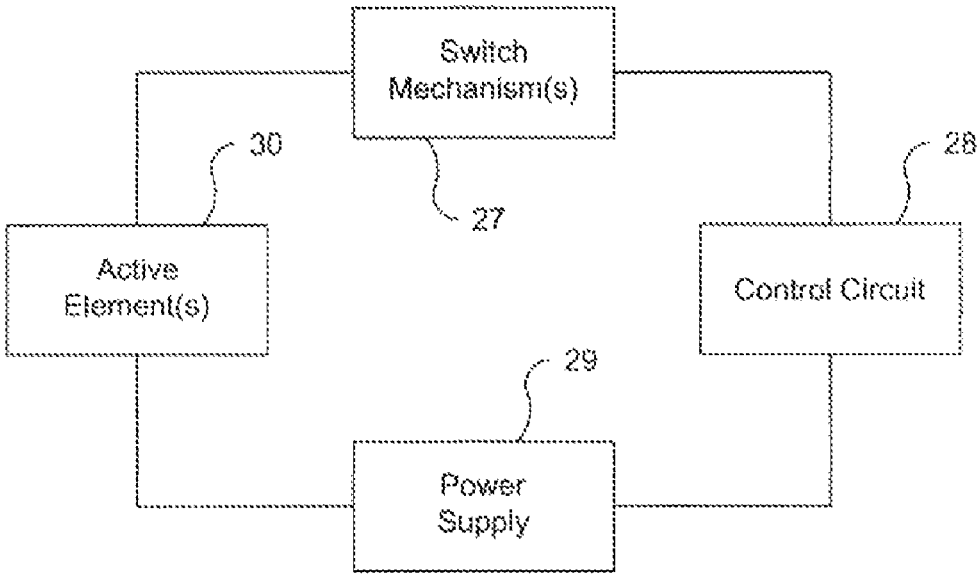

FIG. 16 is a block diagram illustrating electrical connectivity between at least one switch mechanism, at least one active element, a control circuit, and a power supply in accordance with an embodiment of the invention.

DETAILED DESCRIPTION OF THE INVENTION

Reference will now be made in detail to several preferred embodiments of the invention that are illustrated in the accompanying drawings. Wherever possible, same or similar reference numerals are used in the drawings and the description to refer to the same or like parts or steps. The drawings are in simplified form and are not to precise scale. The words communicate, connect, couple, link, and similar terms with their inflectional morphemes do not necessarily denote direct and immediate connections, but also include connections through intermediary elements or devices.

While features of various embodiments are separately described throughout this document, it is understood that two or more such features could be combined into a single embodiment.

It is also understood that the term switch mechanism could include one or more switches with or without elements that facilitate activation of such switches.

The form and function of light, sound, scent, and motion elements described herein enhance the entertainment value of the claimed device during and/or after an interaction with a user.

Figure 1:
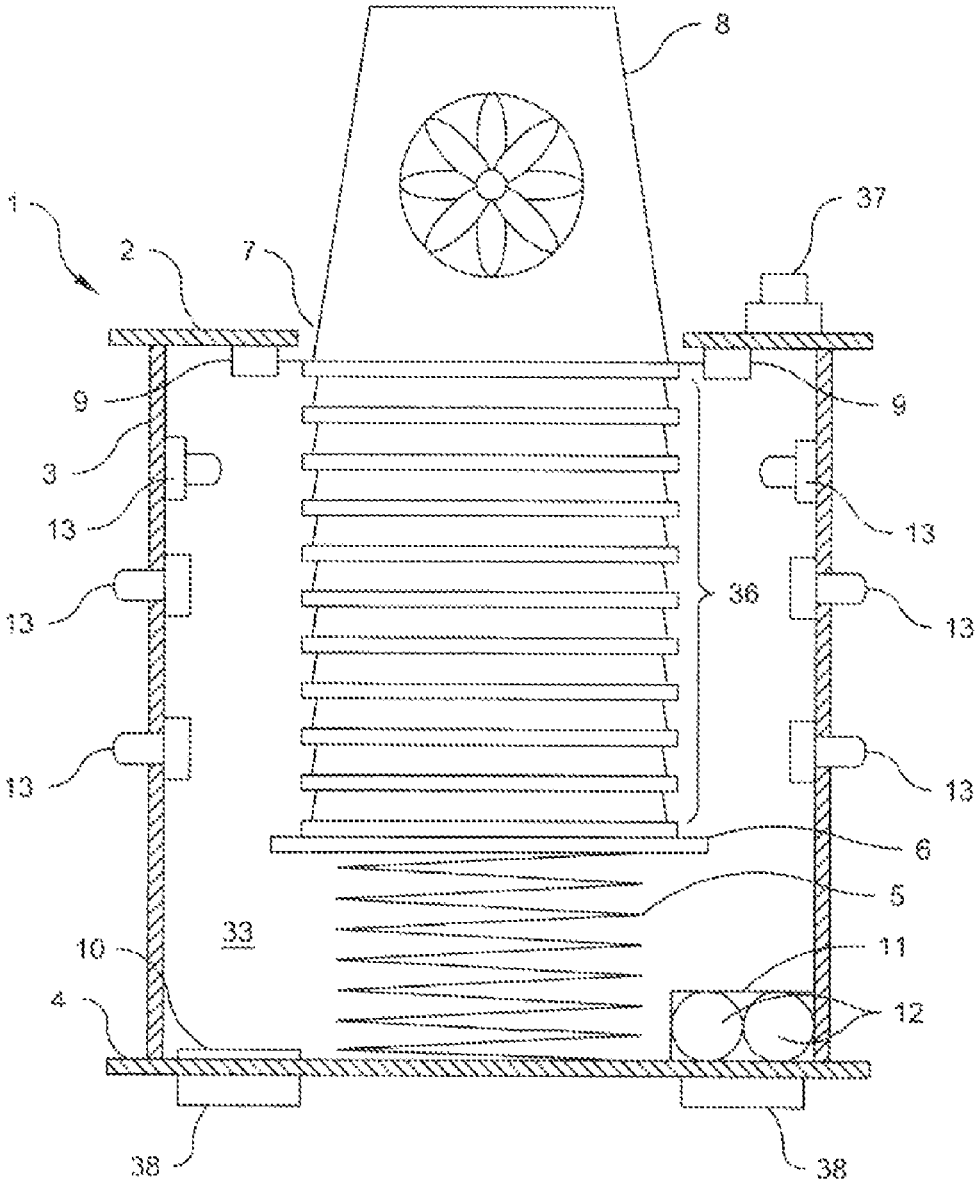
FIG. 1 is a partial section view illustrating switch mechanisms, light-based active elements, circuit board, and power supply disposed within a decorative cup dispenser so that a cup interacts with at least one switch mechanism when manually removed from the dispenser in accordance with an embodiment of the invention.
Figure 2:
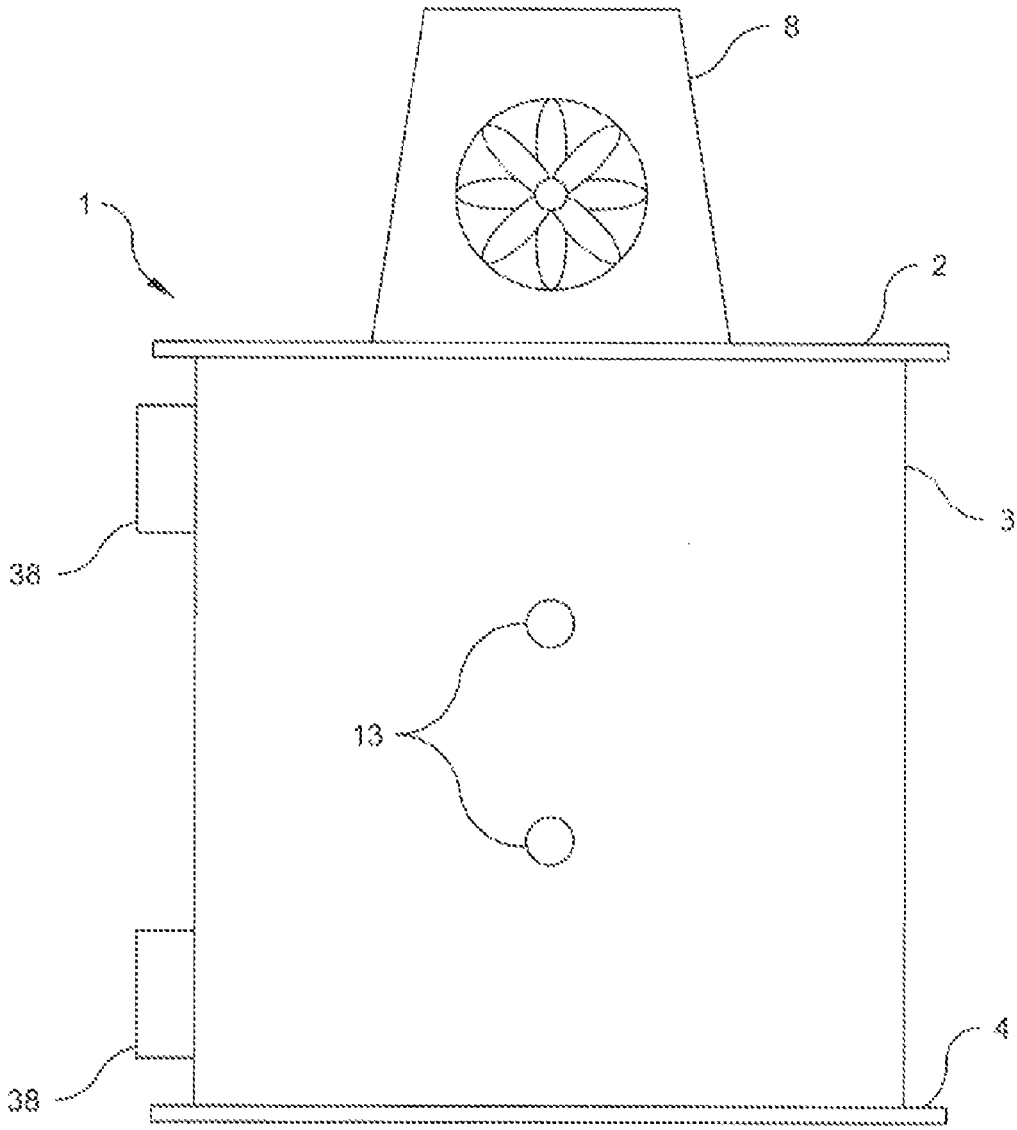
FIG. 2 is a side view illustrating decorative lights positioned along the housing of a cup dispenser and viewable along its exterior in accordance with an embodiment of the invention.
Figure 3:
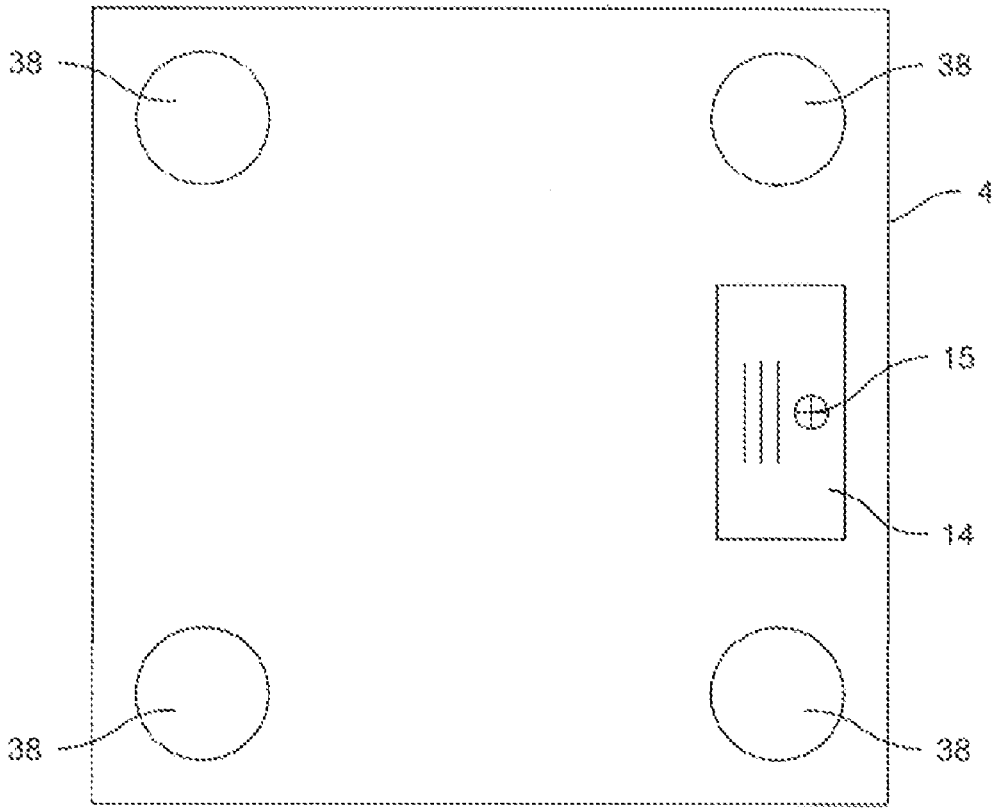
FIG. 3 is a bottom view illustrating optional contact elements and a removable cover along the second cover allowing access to an optional compartment housing a power supply within the cup dispenser in accordance with an embodiment of the invention.

Referring now to FIGS. 1-3, an embodiment of the cup dispenser 1 is shown including a decorative cover comprising a housing 3 disposed between and contacting a first cover 2 and a second cover 4 to form a box-like structure. The housing 3 is a multi-sided or arcuate-shaped element which is substantially tube-like shaped. The first cover 2 could be a substantially planar element with an opening 7, preferably along its center, which is sufficiently large to facilitate the removal of a cup 8 from the cup dispenser 1. The second cover 4 could also be a substantially planar element capable of supporting the cup dispenser 1 in a secure fashion along a countertop within a kitchen, bathroom, or the like. First and second covers 2, 4 could be secured to the housing 3 in a removable fashion, one example being a lid, or fixed thereto via an adhesive or mechanical means, one example being fasteners, or via other means understood in the art. In other embodiments, the housing 3 and first cover 2 or housing 3 and second cover 4 could be molded or otherwise fabricated as a single unit. Housing 3, first cover 2, and second cover 4 could be composed of plastic, metal, cardboard, glass, or other materials suitable for use within residential, commercial, and industrial settings. Materials could include opaque, translucent, and/or transparent compositions, preferably facilitating backlighting from within the decorative cover.

The decorative cover could further include two-dimensional and/or three-dimensional designs along its exterior and interior surfaces to enhance the visual appeal of the cup dispenser 1. Two-dimensional features could include surface ornamentation which is printed or painted directly onto the exterior surface of the housing 3, first cover 2, and/or second cover 4 or applied in paper or film form. Three-dimensional features could be composed of plastic or other lightweight materials attached to or molded onto the housing 3, first cover 2, and/or second cover 4 via various means understood in the art. Features could replicate the appearance of any object. For example, the ornamentation 23 shown in FIGS. 12*b* and 13*b* include the shape and appearance of a flower in either a two-dimensional or a three-dimensional format.

The interior 33 of the cup dispenser 1 could also include an optional spring 5 which is secured to one surface of the second cover 4 and at the other end to a pusher plate 6. The spring 5 could be sufficiently long in its uncompressed state to nearly completely traverse the height of the interior 33 of the cup dispenser 1. The spring 5 could also be sufficiently compressible so as to allow for the insertion and retention of a plurality of cups 8 in a stacked arrangement within the cup dispenser 1. The pusher plate 6 could be a planar element, composed of a plastic, with lateral dimensions at least as large as the diameter of the cup 8. The spring 5 and pusher plate 6 could apply a force of sufficient magnitude onto the cups 8 so as to push the cups 8 towards the opening 7, thus positioning the topmost cup 8 partially through the opening 7 for removal. When the cup dispenser 1 is oriented along a counter or other horizontal surface with the cups 8 extended in an upright orientation, the spring 5 should apply a force onto the cups 8 which at least exceeds that of the downward force applied by the cups 8. When the cup dispenser 1 is oriented so that cups 8 are positioned within the opening 7 via gravity, it is preferred not to include a spring 5. Cups 8 include commercial items composed of paper, plastic, foam or the like, which are stackable and preferably disposable.

The cup dispenser 1 further includes one or more switches 9 attached to one surface of the first cover 2 about the opening 7 via an adhesive or mechanical means. In some embodiments, the switches 9 could be mechanical devices, also understood to include electro-mechanical elements, which interact with the topmost cup 8 within a stack 36 of cups 8 so as to sense its removal from the cup dispenser 1. Mechanically-based switches 9 could further include elements which require activation to close and open a circuit or activation to close a circuit with a delayed reset to then open the same circuit. Exemplary devices include, but are not limited to, vibration, tilt, or momentary switches. In other embodiments, the switches 9 could be optical devices which sense the removal of the topmost cup 8 within a stack 36 via a change in the quantity, quality, or color of light.

The cup dispenser 1 could further include at least one light element 13. In one example, each light element 13 could pass through a like-sized hole so as to be secured along the interior 33 of the housing 3, first cover 2, and/or second cover 4 via an adhesive or mechanical means. One or more light elements 13 could be visible along the exterior of the cup dispenser 1, as represented in FIGS. 1 and 2. In some embodiments, one or more light elements 13 could be concealed within the housing 3 so as to illuminate or backlight the housing 3, first cover 2, and/or second cover 4, as also represented in FIG. 1. Exemplary light elements 13 include, but are not limited to, light emitting diodes (LED), socket-bulb assemblies, and fiber optic light assemblies. Light elements 13 could emit visible and/or invisible light.

The cup dispenser 1 could also include a circuit board 10 and a compartment 11 for batteries 12 or some other DC or AC power supply. The circuit board 10 could be fastened to one surface of the second cover 4 via screws or the like. The circuit board 10 could further include a circuit which activates one or more light elements 13 after an interaction between a cup 8 and one or more switches 9, thus indicating the removal of the cup 8 from the cup dispenser 1. The compartment 11 could be a cavity sufficiently voluminous to hold one or more commercially available batteries 12 in a secure fashion. A removable cover 14 could be located along the second cover 4 so as to allow access to the compartment 11. The removable cover 14 could be a planar-shaped element secured to the second cover 4 via a fastener 15 or the like. It is understood that switch mechanisms, light elements 13, circuit board 10, and compartment 11 are electrically connected to facilitate functionality of the light elements 13 when a cup 8 is removed from the cup dispenser 1. It is also understood that the light elements 13, switch mechanisms, and circuit board 10 could be connected via wires or the like, preferably concealed within the interior 33 of the housing 3 in either a parallel or serial configuration.

In some embodiments, it might be advantageous to include an optional secondary switch 37 disposed along the exterior surface of the decorative cover. The secondary switch 37 could include a mechanically or optically actuated element which operates independent of or separate from one or more switch mechanisms described herein. For example, the secondary switch 37 could be a button-type or depression device which operates to turn ON and OFF one or more light, sound, scent or motion producing elements without the removal of a cup 8. In another example, the secondary switch 37 could operate to turn OFF one or more activated elements after the removal of a cup 8, but before the elements would otherwise cease operating. In yet other examples, the secondary switch 37 could be a light or motion sensor which enables or disables activatable elements depending on ambient light conditions within a room or presence or proximity of a person.

In other embodiments, it might be advantageous to include one or more optional contact elements 38 along the exterior surface of the housing 3 or second cover 4, as represented in FIGS. 1-3. Contact elements 38 could be generally circular or polygonal shaped components which are either adhesively or mechanically attached to the cup dispenser 1. Contact elements 38 could be composed of a rubber-like composition so as to grip or stick to a support surface or a suction cup, magnet, or adhesive strip so as to secure the cup dispenser 1 to a horizontal or vertical surface.

Referring now to FIGS. 4*a* and 4*b*, one exemplary mechanical switch 9 is shown along the first cover 2 contacting the cup 8 along the opening 7. The switch 9 could include a lever arm 16 which extends from the switch 9 so as to be substantially parallel to the rim 31 of the topmost cup 8. In some embodiments, the lever arm 16 could contact the rim 31 and resist the force applied onto the cups 8 and/or optional spring 5, so as to prevent ejection of the cups 8 from the cup dispenser 1. In other embodiments, one or more mechanical stops 59, as represented in FIGS. 8*a* and 8*b*, or other element known within the art could prevent the cups 8 from ejecting from the cup dispenser 1. Stops 59 could be molded or fastened to the cup dispenser 1 via techniques known within the art. The lever arm 16 could be rigid, semi-rigid or flexible and resilient, the latter less likely to damage or otherwise mark cups 8 composed of paper or styrofoam.

The topmost cup 8 is manually removed from the cup dispenser 1 by grasping the body 32 of the cup 8 and pulling the cup 8 away from the interior 33 of the cup dispenser 1. Thereafter, the lever arm 16 rotates upward in the same direction of motion as the cup 8. Rotation of the lever arm 16 closes the circuit which then communicates power to the light elements 13. The lever arm 16 could automatically rotate back to its original position for actuation by another cup 8 and in some embodiments could open the circuit terminating power to the light elements 13.

Referring now to FIGS. 5*a*-5*c*, a cup dispenser 1 is shown including an emitter 39 and a receiver 40 which in combination provide an optically-based, non-contact switch mechanism. The emitter 39 and receiver 40 are commercially available devices capable of separately sending and receiving a light beam 41 within either the visible or invisible spectrum. Emitter 39 and receiver 40 could be attached to the inside surface of the first cover 2 or housing 3, the former represented in FIG. 5*a*, via fasteners or an adhesive. One or more paired arrangements of an emitter 39 and a receiver 40 could be disposed adjacent to the opening 7 about the cups 8 so as to project a light beam 41 across the body 32 and above the rim 31 of the topmost cup 8, as represented in FIG. 5*b*. This arrangement ensures the light beam 41 is broken or interrupted when at least the topmost cup 8 is removed from the cup dispenser 1, as represented in FIG. 5*c*. The interruption event could be used to activate the active elements described herein. In other embodiments, the light beam 41 could initially impinge the body 32 or rim 31 and only reach the receiver 40 as the cup 8 is removed causing activation of the active elements.

Referring now to FIG. 5*d*, it might be advantageous to include one or more an emitter/receiver units 42 which both sends and receives a light beam 41 within the visible or invisible spectrum. The emitter/receiver unit 42 could be a commercially available device including the paired arrangement of separate emitter and receiver devices or a fully integrated device with both emitter and receiver capabilities attached to the first cover 2. The emitter/receiver unit 42 could be arranged so as to project the light beam 41 across the cup 8 as described above so that the light impinges the housing 3. The housing 3 could be painted, shaped, or composed of a material that absorbs, passes, or reflects the light beam 41 so that it does not return to the emitter/receiver unit 42. The emitter/receiver unit 42 and cup 8 could be arranged to allow the light beam 41 to impinge the rim 31 of the cup 8 as the cup 8 is removed from the cup dispenser 1 so as to produce a reflected beam 43 which is returned to and received by the emitter/receiver unit 42. In other embodiments, the light beam 41 could initially impinge the rim 31 and pass the cup 8 as it is removed from the cup dispenser 1. The absence or presence of the reflected beam 43 could be used to trigger activation of the active elements described herein depending on whether the reflected beam 43 was an initial or transient condition.

Referring now to FIGS. 6*a*-6*d*, a cup dispenser 1 is shown including a means to indirectly communicate the removal of a cup 8 to an optical switch mechanism via an expandable ring 44. The expandable ring 44 is a circular-shaped structure with a gap. A first arm 50 and a second arm 51 extend from the circular-shaped structure about the gap in a substantially parallel arrangement, as represented in FIG. 6*b*. The expandable ring 44 could be composed of a plastic or other resilient material which expands, bends and/or flexes so as to allow the second arm 51 to deflect horizontally and/or vertically with respect to the first cover 2; however, the recovery time of the expandable ring 44 should be sufficiently short so as to prevent the remaining cups 8 within the cup dispenser 1 from ejecting. In some embodiments, it might be advantageous to include a spring between the second arm 51 and housing 3 to assist in the recovery. The first arm 50 could be fixed and attached to a flange 48 via a fastener 49 so as to be both parallel and separate from the first cover 2, as represented in FIG. 6*c*. The flange 48 could be a substantially planar element which is molded onto or attached to the housing 3 via a fastener or adhesive.

The circular-shaped portion of the expandable ring 44 is positioned so as to align with the opening 7 along the first cover 2 in a substantially concentric arrangement, as represented in FIGS. 6*a*-6*c*. The inner dimensions of the circular portion should allow at least a substantial portion of the body 32 and rim 31 of the cup 8 to pass without contacting the expandable ring 44. In some embodiments, the inner diameter of the expandable ring 44 should be less than the outer diameter of the rim 31. It is preferred that at least the rim 31 contacts the expandable ring 44 as the cup 8 is removed from the cup dispenser 1.

An emitter 45 and receiver 46 could be attached via mechanical fasteners or an adhesive to the inside surface of the first cover 2 about the second arm 51, as represented in FIGS. 6*b* and 6*d*. The emitter 45 and receiver 46 could be devices as described herein. The second arm 51 could include one or more openings 52 which allow a light beam 47 from the emitter 45 to reach the receiver 46, as represented in FIG. 6*d*. In some embodiments, deflection of the expandable ring 44 could allow the second arm 51 to rotation, bend or flex vertically and/or horizontally with respect to the light beam 47 so that the opening 52 is no longer aligned along the light beam 47. This arrangement would interrupt the light beam 47, thus preventing it from reaching the receiver 46. The interruption event could be used to activate the active elements described herein. Other arrangements are possible whereby the light beam 47 is initially blocked by the second arm 51 and reaches the receiver 46 only after deflection of the second arm 51 via the removal of a cup 8, thereafter triggering activation of the active elements.

Referring now to FIGS. 7*a* and 7*b*, the cup dispenser 1 described in FIGS. 6*a*-6*d* is now shown including a means to indirectly communicate the removal of a cup 8 to a mechanically activatable switch 60 via an expandable ring 44. The switch 60 could be attached via mechanical fasteners or an adhesive to the inside surface of the first cover 2 to one side of the second arm 51, as represented in FIG. 7*b*. The second arm 51 could contact or nearly contact the switch 60. The switch 60 could be a button-type device which activates a circuit when mechanically depressed and resets automatically after a depressive force is removed. In this embodiment, deflection of the expandable ring 44 accompanying the removal of a cup 8 from the cup dispenser 1 could allow the second arm 51 to rotation, bend or flex onto the switch 60, thereby applying a mechanical force thereto so as to activate the switch 60 and circuit controlling function of the active elements. After the cup 8 is completely removed from the cup dispenser 1, the expandable ring 44 recovers its original shape and the switch 60 returns to its initial physical and electrical states for subsequent actuation.

Referring now to FIGS. 8*a*-8*c*, a cup dispenser 1 is shown having a means to indirectly communicate the removal of a cup 8 to a mechanically activatable switch 58 via a rocker element 56. The rocker element 56 could include a circular-shaped structure having a lower arm 55 extending horizontally therefrom and a substantially T-shaped upper arm 54 extending vertically therefrom. The region between the upper and lower arms 54, 55 could be mechanically fastened to a flange 48 via a pin 53 so as to be rotatable with respect to the flange 48. The flange 48 could be attached or molded onto the housing 3. Other shapes and designs are possible for the rocker element 56, as represented in FIG. 8*d*.

The lower arm 55 of the rocker element 56 should be sufficiently long so as to contact or nearly contact the housing 3, yet allow the rocker element 56 to rotate about the pin 53 in a non-binding fashion. The upper arm 54 should be sufficiently long and the top sufficiently wide so as to allow contact with a rim 31 along a cup 8 at one end and contact or near contact with a switch 58 along the other end. The end contacting the rim 31 should ride against the rim 31 in a non-binding fashion during the removal of a cup 8. The ends of the lower arm 55 and upper arm 54 could be tapered or otherwise shaped so as to improve functionality, as represented in FIG. 8*d*. The switch 58 could be a button-type device which activates a circuit when mechanically depressed and resets automatically after a depressive force is removed. The switch 58 could be mechanically attached to the housing 3 or first cover 2 via an adhesive or mechanical fastener.

In this embodiment, the removal of a cup 8 from the cup dispenser 1 communicates the outward motion of the cup 8 onto the upper arm 54 causing the rocker element 56 to rotate towards the switch 58, thereafter depressing and actuating the switch 58. After the cup 8 is completely removed from the cup dispenser 1, the rocker element 56 could rotate back towards the topmost cup 8 within the cup dispenser 1, thus allowing the switch 58 to return to its initial physical and electrical states for subsequent actuation. In some embodiments, the switch 58 could include a spring or other compressible and resilient element which causes it to reset and return the rocker element 56 to its original position. In other embodiments, the rocker element 56 could be designed so as to have a weight profile which prefers non-activation of the switch 58. In yet other embodiments, a spring 57 could reside between and be attached to the flange 48 and rocker element 56, as represented in FIG. 8*c*, so as to bias the rocker element 56 away from the switch 58 and return the rocker element 56 to its initial position after the removal of a cup 8.

In some embodiments, two or more rocker elements 56 could be positioned about an opening 7 along the first cover 2 so as to prevent the ejection of the remaining cups 8 from the cup dispenser 1. Some rocker elements 56 might not contact a switch 58. In other embodiments, one or more rocker elements 56 could be positioned about the opening 7 in conjunction with one or more mechanical stops 59 so as to prevent ejection of the remaining cups 8 from the cup dispenser 1, as represented in FIG. 8*b*.

Referring now to FIG. 8*d*, the rocker elements 56 could function to block a light beam 47 projected from an emitter 45 to a receiver 46, as similarly described for the embodiment in FIGS. 6*a*-6*d*. In this embodiment, the rocker element 56 is now disposed between an emitter 45 and a receiver 46 and includes an opening 52. In one example, the opening 52 could initially be aligned with the light beam 47 and rotate after removal of a cup 8 to interrupt the light beam 47 from the receiver 46. In another example, the opening 52 could initially block the light beam 47 at the receiver 46 and rotate after the removal of a cup 8 to align the opening 52 with the light beam 47 so as to allow the light beam 47 to reach the receiver 46. The presence/absence or absence/presence of light at the receiver 46 could be used to activate the active elements.

Referring now to FIGS. 9*a*-9*c*, a cup dispenser 1 is shown having a means to indirectly communicate the removal of a cup 8 to a mechanically activatable switch 64 via a roller 65. The roller element 65 could be disposed between a pair of flanges 61 which extend from the housing 3 in a nearly perpendicular arrangement, as represented in FIG. 9*a*. The flanges 61 are preferred to be disposed about a cup 8 through an opening 7 along the first cover 2. Flanges 61 could be molded or attached to the housing 3 via a fastener or an adhesive.

The roller element 65 includes a sprocket 63 fixed at one end thereof via an adhesive or fastener. The sprocket 63 further includes a plurality of teeth 66 or the like which extend from the circumference of the sprocket 63 in an outward radial fashion, as represented in FIG. 9*b*. The sprocket 63 could be composed of a polymer material, examples being polypropylene or nylon. The roller element 65 and sprocket 63 are attached to the flanges 61 via a shaft 62, which passes through an opening along each element at least a large as the shaft 62, so as to be jointly and freely rotatable thereon. The shaft 62 could be an elongated rod-shaped element composed of a polymer or metal.

The sprocket 63 is positioned so as to allow contact between the teeth 66 and a switch 64. The switch 64 could be a leaf-type device which closes and opens so as to activate and/or deactivate a circuit. The switch 64 could be attached to the housing 3 adjacent to the first cover 2, as represented in FIG. 9*b*, via a fastener or an adhesive. The roller element 65 is positioned so as to contact a cup 8 extending through an opening 7 along the first cover 2, as represented in FIG. 9*c*. In preferred embodiments, the roller element 65 should contact a portion of the body 32 adjacent to and including the rim 31. This arrangement ensures rotation of the roller element 65 during extraction of at least the topmost cup 8.

During extraction of a cup 8, the roller element 65 is rotated so that one or more teeth 66 press against and rotate past the switch 64, thereby closing the switch 64 one or more times. The exemplary embodiment in FIG. 9*b* shows a tooth 66 contacting a first arm 70 with an electrical contact. Rotation of the roller element 65 causes the tooth 66 to press against first arm 70 thereby moving it towards a second arm 71 with an electrical contact. Contact between the first and second arms 70, 71 enables activation of the active elements within the cup dispenser 1. The deflection of the first arm 70 by the tooth 66 should be sufficient for the tooth 66 to rotate past the switch 64 allowing the next tooth 66 to engage the switch 64 in a repeating pattern. The first arm 70 should be sufficiently resilient or mechanically actuated so as to return to its initial position after deflection by a tooth 66. The recovery time of the first arm 70 should be sufficiently quick so that it is properly positioned before engagement by a subsequent tooth 66.

The roller element 65 could be cylindrically shaped and composed of a polymer, rubber, foam or the like which is rigid, semi-rigid, or compressible and resilient. In some embodiments it might be advantageous for the roller element 65 to compress when contacting a cup 8, as represented in FIG. 9*a*. In other embodiments, the roller element 65 could gently stick to a cup 8 via a tacky, textured or rough contact surface.

Referring now to FIGS. 11*a* and 11*b*, the roller element 65 is shown as a generally cylindrical-shaped element with a plurality of fingers 69 disposed along the outer surface thereof. The fingers 69 could be generally elongated protrusions, with or without barbed-like ends, which extend outwardly from the roller element 65 in a random or ordered fashion. In some embodiments, the roller element 65 could be composed of a plastic core with generally flexible projections attached thereto, similar to the hooks on Velcro®, as represented in FIG. 11*a*. In other embodiments, the roller element 65 could be composed of a polymer, elastomer, or rubber whereby the fingers 69 are integrally molded onto a plastic core, as represented in FIG. 11*b*. In yet other embodiments, the fingers 69 could be composed of or covered with a composition that generally replicates the tackiness of an adhesive, so as to generally adhere to a cup 8 as it passes by the roller element 65, thus rotating the roller element 65.

Referring now to FIGS. 10*a*-10*c*, the cup dispenser 1 described in FIGS. 9*a*-9*c* is shown having a means to indirectly communicate the removal of a cup 8 to an optical switch mechanism including an emitter 45 and receiver 46 via a roller 65. The roller element 65 could be disposed between a pair of flanges 61 which extend from the housing 3 in a nearly perpendicular arrangement, as represented in FIG. 10*a*. The flanges 61 are preferred to be disposed about a cup 8 through an opening 7 along the first cover 2. The roller element 65 includes an encoder 67 fixed at one end thereof via an adhesive or fastener. The encoder 67 further includes a plurality of openings 68 disposed there through in a circular pattern, as represented in FIG. 10*b*, preferably evenly spaced. The encoder 67 could be composed of a polymer material, examples being polypropylene or nylon. The roller element 65 and encoder 67 are attached to the flanges 61 via a shaft 62, which passes through an opening along each element at least a large as the shaft 62, so as to be jointly and freely rotatable thereon.

The emitter 45 and receiver 46 are each attached to the inside of the first cover 2 via a fastener or an adhesive adjacent to the roller element 65. The encoder 67 is positioned between the emitter 45 and receiver 46 so that the openings 68 separately allow a light beam 47 to pass from the emitter 45 to the receiver 46 as the encoder 67 rotates. The spacing between two adjacent openings 68 should be sufficient wide so as to prevent the light beam 47 and rays therefrom from reaching the receiver 46 during rotation between the openings 68.

The roller element 65 is positioned so as to contact a cup 8 extending through an opening 7 along the first cover 2, as represented in FIG. 9*c*. In preferred embodiments, the roller element 65 should contact a portion of the body 32 adjacent to and including the rim 31. This arrangement ensures rotation of the roller element 65 during extraction of at least the topmost cup 8.

During extraction of a cup 8, contact between the cup 8 and roller element 65 is sufficient for the roller element 65 to be rotated so that the light beam 47 between the emitter 45 and receiver 46 is passed between the units when an opening 68 is aligned along the path of the light beam 47 and is blocked when the opening 68 is no longer aligned along the path. The rapid sequential presence and absence of light at the receiver 46 one or more times is used to activate and/or deactivate active elements within the cup dispenser 1.

Referring now to FIGS. 12*a* and 12*b*, the cup dispenser 1 is shown including at least one motor element 17 attached to the housing 3 along its interior 33. Each motor element 17 could be secured to the housing 3 via an adhesive or mechanical means. Exemplary motor elements 17 include, but are not limited to, motors, solenoids, bimetals, and piezoelectric devices either directly coupled or indirectly coupled via levers, gears, or the like to an ornament or decorative element. In one example, the motor element 17 could include a shaft 18 which extends from the motor element 17 through an opening 35 along the housing 3. The shaft 18 could be attached to an ornament 19 or the like which resides along the exterior 34 of the cup dispenser 1. In another example, the motor element 17 could be a driver element or fully integrated device such as an animated device which resembles a character, one specific example being an animated doll. It is understood that the switch mechanisms, motor elements 17, circuit board 10, and/or compartment 11 are electrically connected to facilitate functionality of the motor elements 17 when a cup 8 is removed from the cup dispenser 1. Actuation of one or more switch mechanisms described herein could be communicated to the circuit board 10 which then communicates power to the motor elements 17. Each motor element 17 could move a corresponding ornament 19 along a predetermined path, including but not limited to linear and/or rotational motion, the latter represented in FIG. 12*b*.

Referring now to FIGS. 13*a* and 13*b*, the cup dispenser 1 is shown including at least one dispenser 20 attached to the housing 3 along its interior 33. Each dispenser 20 could be secured to the housing 3 via an adhesive or mechanical means, and include a port 21 which passes through a like-dimensioned hole along the housing 3. The dispenser 20 could produce a cloud 22. Exemplary means for producing a cloud 22 include, but are not limited to, atomization, heating, evaporation, airflow, pressure, and vibration. In one example, the dispenser 20 could be a pump-like device. Clouds 22 could be composed of, but not limited to, powder or gaseous particulates, a gas, a vaporized liquid, or liquid particulates having the scent of an air freshener, menthol, eucalyptus, or the like. The cloud 22 could be released in response to commands from the circuit board 10 so as to produce a fragrant scent along the exterior 34 adjacent to the cup dispenser 1. It is understood that the switch mechanisms, dispensers 20, circuit board 10, and compartment 11 are electrically connected to facilitate functionality of the dispensers 20. Activation of one or more switch mechanisms could be communicated to the circuit board 10 which then communicates power to the dispensers 20 when a cup 8 is removed from the cup dispenser 1. Each dispenser 20 could include ornamentation or other design features described herein along the housing 3 about the port 21 so as to compliment its functionality. For example, FIG. 13*b* shows a flower type pattern about the port 21.

Referring now to FIGS. 14*a* and 14*b*, the cup dispenser 1 is shown including at least one audio element 24 attached to the housing 3 along its interior 33. Each audio element 24 could be secured to the housing 3 via an adhesive or mechanical means. The audio element 24 emits sound waves 26 based on commands from the circuit board 10 so as to project music or other audio signals into the exterior 34 adjacent to the cup dispenser 1. Audio elements 24 could include piezo buzzers, speakers, or fully integrated audio devices, examples including, but not limited to a radio or digital audio player. Sound waves 26 generated by each audio element 24 pass through a plurality of openings 25 along the housing 3. It is understood that the switch mechanisms, audio elements 24, circuit board 10, and compartment 11 are electrically connected to facilitate functionality of the audio elements 24 when a cup 8 is removed from the cup dispenser 1. Actuation of one or more switch mechanisms could be communicated to the circuit board 10 which then communicates power to the audio elements 24 so as to play an audio signal which could include a digital file stored on the circuit board 10.

A variety of serial and parallel circuit configurations are possible within the cup dispenser 1, as represented in FIGS. 15 and 16. Active elements 30 are understood to include devices which emit light, sound, or scent or move an object, as otherwise described herein. Connectivity represented between elements in FIGS. 15 and 16 could include physically-based embodiments via one intermediate connection, one example being a wire. Switch mechanisms 27 include the various direct contact, indirect contact, and non-contact embodiments described herein.

Referring now to FIG. 15, an exemplary arrangement of electrical components includes one or more switch mechanisms 27, a power supply 29, and one or more active elements 30 separately electrically coupled to and communicating with a control circuit 28. The ON and OFF states of the switch mechanisms 27 could be communicated to the control circuit 28. The control circuit 28 is powered by the power supply 29 which could include a DC supply via batteries or an AC supply via an external power cord through an AC-to-DC converter. Power from the power supply 29 is also communicated to energize the active elements 30 via the control circuit 28. In their energized state, the active elements 30 are capable of emitting light, sound, and scent or moving an object.

The control circuit 28 facilitates functionality of the active elements 30 and could reside on the circuit board 10 or other suitable structure. For example, the control circuit 28 could include a timer circuit to control the duration during which light is emitted by the light elements 13 or a circuit that selectively activates and deactivates light elements 13 in a repeating or random pattern. In some embodiments, the control circuit 28 could include a circuit which processes and interprets motion or light data from a secondary switch 37. In other embodiments, the control circuit 28 could include a digital storage element and circuit to control the functionality and content of sound emitting elements. In yet other embodiments, the control circuit 28 could be directly integrated into each active element 30. In yet further embodiments, the control circuit 28 could interpret signals from one or more switch mechanisms 27 described herein to determine the direction of activation or stimulus, examples being the loading and removal of one or more cups 8, thus allowing the proper actuation.

Referring now to FIG. 16, an exemplary diagram is described whereby one or more switch mechanisms 27, including the switches described herein and their equivalents, are electrically connected to one or more active elements 30, a power supply 29, and a control circuit 28 in a serial arrangement. Initially, the switch mechanisms 27 and active elements 30 are OFF and non-functioning, thus avoiding depletion of a power supply 29 with finite storage capacity. In some embodiments, the removal of a cup 8 could cause at least one switch mechanisms 27 to close, thereby completing the circuit so as to turn ON the active elements 30, which function as described herein. In other embodiments, depression of a secondary switch 37 could close the circuit, thereby completing the circuit and turning ON the active elements 30. Other circuit arrangements are possible including circuits which enable activation via movement of the cup dispenser 1 or some other stimulus not related to the removal of a cup 8. The control circuit 28 could ensure functionality of the active elements 30 even after the circuit is open by the automatic or manual reset of one or more switch mechanisms 27.

In some embodiments, the active elements 30 could remain active, after initially energized, for a predefined time period programmed into a counter circuit on the control circuit 28. For example, light elements 13 could remain lit, or the motor element 17 could remain powered, or the audio element 24 could emit music for several seconds or minutes after a cup 8 is removed from the cup dispenser 1. In another example, the cup dispenser 1 could emit one or more distinct scent clouds 22 or continuously emit a single cloud 22 for several seconds after a cup 8 is removed from the cup dispenser 1. The actual duration of each visual, audio, or smell effect is application and design dependent. In other embodiments, the active elements 30 could remain active after initially energized until a subsequent event is detected by the control circuit 28. For example, the control circuit 28 could terminate power to the active elements 30 when a user depresses the secondary switch 37 along the cup dispenser 1. In another example, the active elements 30 could function until the energy stored within the power supply 29 falls below or usage exceeds a defined value as monitored by a circuit within the control circuit 28 or on the circuit board 10.

In yet other embodiments, the switch mechanisms 27 could repeatedly open and close the circuit attached to the active elements 30 or turn the active elements 30 ON and OFF in rapid succession. It is preferred for the first close or ON event from the switch mechanisms 27 to trigger the active elements 30 which then remain active for a predetermined duration or cycle. Thereafter, the active elements 30 could be reactivated by another closed or ON event so that their activation is controlled by the control circuit 28 described herein via software executing a non-interrupt activation method or other methodology.

Functionality of the active elements 30 described herein could be based in part or whole upon whether the cups 8 are loaded or removed from the cup dispenser 1. In some embodiments, it is possible for a switch mechanism 27 and/or control circuit 28 to not activate any light, sound, motion, and/or scent elements when cups 8 are loaded into the cup dispenser 1; however, the same arrangement would enable activation when at least one cup 8 is removed.

In these embodiments, switch mechanisms 27 could be insensitive to a stimulus indicative of a loading condition. Lever-based switches might not cause activation when depressed inward, but rather initiate activation when depressed outward. The ring and rocker mechanisms could include chamfers or other design features which avoid activation of the control circuit 28 when cups 8 contact surfaces associated with loading. Roller mechanisms could avoid activation when rotated in a counter-clockwise direction indicative of loading and allow activation when rotated clockwise by the removal of a cup 8.

Optically-based switches could avoid activation based upon the number, frequency, time, or order between interruptions or receptions. A simple emitter 39 and receiver 40 as in FIG. 5*a* could avoid activation when two or more interruptions are received in rapid succession. A simple emitter/receiver unit 42 as in FIG. 5*d* could avoid activation when two or more interruptions are received in rapid succession. The ring and rocker arrangements in FIGS. 6*b* and 8*d*, respectively, could include three openings 52 which allow for either a short delay or a long delay between the reception of signals dependent on the direction of rotation. For example, the spacing between the centermost opening 52 and a first opening 52 along one side could be shorter indicative of loading and the spacing between the centermost opening 52 and a second opening 52 opposite of the first opening 52 could be longer indicative of removal. The roller arrangement in FIG. 10*a* could allow for faster rotation in one direction indicative of loading and slower rotation in the other direction indicating removal.

In other embodiments, it is possible for a switch mechanism 27 and/or control circuit 28 to activate light, sound, motion, and/or scent elements so as to produce one response when cups 8 are loaded into the cup dispenser 1 and another response when cups 8 are removed from the cup dispenser 1. The responses could be the same or different. This dual-functionality could be controlled by a single switch or separately by two or more switches. Other functionalities described herein are likewise applicable to these embodiments.

As is evident from the explanation above, the described cup dispenser and variations thereof provide a decorative item with elements which enhance the appearance and functional characteristics of an otherwise utilitarian item commonly found in residential, commercial, and industrial settings. Accordingly, the described invention is expected to be sold by retailers and the like to purchasers whom perceive value in a use-activated dispenser which interacts with one or more senses of a user. The description above indicates that a great degree of flexibility is offered in terms of the present invention. Although devices and methods have been described in considerable detail with reference to certain preferred versions thereof, other versions are possible. Therefore, the spirit and scope of the appended claims should not be limited to the description of the preferred versions contained herein.

What is claimed is:

1. A manual cup dispenser comprising:

(a) a decorative cover including an opening at one end for a manual removal of at least one of a plurality of cups stacked within said decorative cover;

(b) at least one switch mechanism disposed adjacent to said opening;

(c) at least one active element disposed along said decorative cover, said at least one active element producing light, sound, scent, and/or motion for a finite period after at least one said cup is manually and completely removed by a user from said manual cup dispenser so as to turn ON said at least one active element, said at least one active element having a form and/or a function that enhances an entertainment value of said manual cup dispenser, a duration of said finite period based on a time or an event independent of said manual removal of said cup, said at least one active element turned OFF after said finite period; and (d) a control circuit which communicates with said at least one switch mechanism and/or said at least one active element to control a functionality of said at least one active element.

2. The manual cup dispenser of claim 1, wherein said at least one switch mechanism directly contacts at least one said cup.

3. The manual cup dispenser of claim 2, wherein said at least one switch mechanism is vibration, tilt, lever, or momentary activated.

4. The manual cup dispenser of claim 1, wherein said at least one switch mechanism does not contact said plurality of cups.

5. The manual cup dispenser of claim 4, wherein said at least one switch mechanism is activated via an interrupt of visible or invisible light.

6. The manual cup dispenser of claim 4, wherein said at least one switch mechanism is activated via a reflection of visible or invisible light.

7. The manual cup dispenser of claim 1, wherein said at least one switch mechanism communicates contact with at least one said cup to a switch.

8. The manual cup dispenser of claim 7, wherein said at least one switch mechanism includes an expansion ring which activates said at least one active element when at least one said cup is removed from said manual cup dispenser and said switch is either mechanical or optical.

9. The manual cup dispenser of claim 7, wherein said at least one switch mechanism includes a rocker element which activates said at least one active element when at least one said cup is removed from said manual cup dispenser and said switch is either mechanical or optical.

10. The manual cup dispenser of claim 7, wherein said at least one switch mechanism includes a roller element which activates said at least one active element when at least one said cup is removed from said manual cup dispenser and said switch is either mechanical or optical.

11. The manual cup dispenser of claim 10, wherein said roller element has a plurality of fingers extending therefrom which contact at least one said cup so as to activate said at least one active element.

12. The manual cup dispenser of claim 1, wherein said at least one active element illuminates said decorative cover.

13. The manual cup dispenser of claim 1, further comprising:

(e) a spring mechanism disposed within said decorative cover so as to assist said manual removal of at least one said cup.

14. The manual cup dispenser of claim 1, further comprising:

(e) a secondary switch disposed along said decorative cover and capable of activating and/or deactivating said at least one active element separate from or independent of said manual removal of at least one said cup.

15. The manual cup dispenser of claim 1, further comprising:

(e) at least one contact element disposed along an exterior of said manual cup dispenser for securing said manual cup dispenser along a support surface.

16. The manual cup dispenser of claim 1, wherein said at least one active element is a light emitting diode, a socket-bulb assembly, or a fiber optical element.

17. The manual cup dispenser of claim 1, wherein said at least one active element is a piezo buzzer, a speaker, or an audio device.

18. The manual cup dispenser of claim 1, wherein said at least one active element produces scent via atomization, heating, evaporation, airflow, pressure, or vibration.

19. The manual cup dispenser of claim 1, wherein said at least one active element is a motor, a solenoid, a bimetal, or a piezoelectric device.

20. The manual cup dispenser of claim 1, wherein said at least one active element is not activated when said cups are loaded into said manual cup dispenser and activated when at least one of said cups is removed from said manual cup dispenser.

21. The manual cup dispenser of claim 1, wherein one said switch mechanism is activatable when at least one said cup is loaded into and removed from said manual cup dispenser.

22. The manual cup dispenser of claim 1, wherein one said switch mechanism is activatable when at least one said cup is placed into said manual cup dispenser and another said switch mechanism is activatable when at least one said cup is removed from said manual cup dispenser.

23. The manual cup dispenser of claim 22, wherein said functionality of said at least one active element differs between loading and removal.

* * * * *

UNITED STATES PATENT AND TRADEMARK OFFICE

CERTIFICATE OF CORRECTION

PATENT NO. : 8,297,471 B2
APPLICATION NO. : 13/119241
DATED : October 30, 2012
INVENTOR(S) : Christopher P. Dooley et al.

It is certified that error appears in the above-identified patent and that said Letters Patent is hereby corrected as shown below:

Cover Page, (76) Inventors, line 2

Delete "Loren Tayior" and insert --Loren Taylor--

Signed and Sealed this
First Day of January, 2013

David J. Kappos

David J. Kappos
*Director of the United States Patent and Trademark Office*